US008424574B2

(12) United States Patent
Whiteman

(10) Patent No.: US 8,424,574 B2
(45) Date of Patent: Apr. 23, 2013

(54) COMPRESSED GAS TRANSFER SYSTEM

(75) Inventor: Paul Anthony Whiteman, Sanctuary Cove (AU)

(73) Assignee: Mosaic Technology Development Pty Ltd., Stapylton, Queensland (AU)

( * ) Notice: Subject to any disclaimer, the term of this patent is extended or adjusted under 35 U.S.C. 154(b) by 744 days.

(21) Appl. No.: 12/517,785

(22) PCT Filed: Dec. 19, 2007

(86) PCT No.: PCT/AU2007/001962

§ 371 (c)(1),
(2), (4) Date: Feb. 10, 2010

(87) PCT Pub. No.: WO2008/074075

PCT Pub. Date: Jun. 26, 2008

(65) Prior Publication Data

US 2010/0139777 A1 Jun. 10, 2010

(30) Foreign Application Priority Data

Dec. 21, 2006 (AU) ..... 2006-907177

(51) Int. Cl.
*B65B 1/20* (2006.01)
*F17C 13/00* (2006.01)

(52) U.S. Cl.
USPC ..... 141/231; 141/18; 141/47; 141/197

(58) Field of Classification Search ..... 141/4–5, 141/18, 21, 25, 27, 47, 51, 67, 197, 94–95, 141/234, 104, 231
See application file for complete search history.

(56) References Cited

U.S. PATENT DOCUMENTS

| | | | | |
|---|---|---|---|---|
| 3,895,493 | A * | 7/1975 | Rigollot | 60/659 |
| 4,805,674 | A | 2/1989 | Knowlton | |
| 5,163,409 | A | 11/1992 | Gustafson et al. | |
| 5,253,682 | A | 10/1993 | Haskett et al. | |
| 5,421,162 | A | 6/1995 | Gustafson et al. | |
| 5,454,408 | A | 10/1995 | DiBella et al. | |
| 5,884,675 | A | 3/1999 | Krasnov | |
| 6,202,707 | B1 | 3/2001 | Woodall et al. | |
| 6,263,864 | B1 * | 7/2001 | Kelley | 123/527 |
| 6,439,278 | B1 | 8/2002 | Krasnov | |
| 2006/0137332 | A1 | 6/2006 | Allgeier et al. | |

FOREIGN PATENT DOCUMENTS

WO 9220955 A1 11/1992

OTHER PUBLICATIONS

PCT International Search Report, dated Apr. 4, 2008, mailed Apr. 10, 2008, in PCT/AU2007/001962.
PCT International Preliminary Report on Patentability dated Sep. 30, 2008, mailed Feb. 17, 2009, in PCT/AU2007/001962.

* cited by examiner

*Primary Examiner* — Timothy L Maust
*Assistant Examiner* — Timothy Kelly
(74) *Attorney, Agent, or Firm* — Fitzpatrick, Cella, Harper & Scinto

(57) ABSTRACT

A compressed gas transfer system comprising at least one first pressure vessel able to hold a volume of gas; and a first gas line to allow gas to pass out of the at least one first pressure vessel wherein the volume of the first pressure vessel is able to be varied to maintain the gas within the pressure vessel at a constant pressure.

5 Claims, 38 Drawing Sheets

COMPRESSED GAS TRANSFER SYSTEM

FIELD OF THE INVENTION

This invention relates to a compressed gas transfer system. In particular, the invention relates to the compression and transfer of natural gas with a focus on providing a complete solution for fuelling commercial vehicles with compressed natural gas. However, it is envisaged that the compressed gas transfer system may be used for other applications.

BACKGROUND OF THE INVENTION

Natural gas fuels have been found to be one of the most environmentally friendly fuels for use in vehicles and hence the desire by environmental groups and governments to support the use of natural gas in road going applications. Natural gas based fuels are commonly found in three forms; Compressed Natural Gas (CNG), Liquefied Natural Gas (LNG) and a derivative of natural gas, Liquefied Petroleum Gas (LPG).

Natural gas fuelled vehicles have impressive environmental credentials as they emit very low levels of $SO_2$ (sulphur dioxide), soot or other particulate matter, and compared to gasoline and diesel powered vehicles, their emission of $CO_2$ (carbon dioxide) is potentially lower due to a more favourable carbon-hydrogen ratio in the fuel. Natural gas vehicles come in a variety of types, from small cars to (more commonly) small trucks and buses. Natural gas fuels also potentially provide engines with a longer service life and lower maintenance costs. Further, CNG is the least expensive alternative fuel when comparing equal amounts of fuel energy. Still further, natural gas fuels can be combined with other fuels, such as diesel, to provide similar benefits mentioned above.

A key factor limiting the use of natural gas in vehicles is the storage of the natural gas fuel which, in the case of CNG and LNG, the fuel tanks are expensive, large and cumbersome relative to tanks required for conventional liquid fuels with the same energy content. In addition, the lack of availability of CNG and LNG refuelling facilities and the cost of LNG add further limitations on the use of natural gas as a fuel in mobile applications. Further, in the case of LNG, the cost and complexity of producing LNG and the issues associated with storing a cryogenic liquid on a vehicle further limits the potential uptake of this fuel.

This is not quite the same for LPG, which is not a cryogenic liquid, and this fuel is widely used in high mileage motor cars such as taxis. However, the cost benefits are not as clear as in the case of private motor cars and the issues associated with the size and shape of the fuel tank, the cost variability of LPG and the relatively limited supply means that LPG has its limitations also. Consequently, without massive investment in a network of LNG plants around the major transport hubs, CNG is the only feasible form of natural gas that is likely to be widely utilised in the near future.

The method for delivering natural gas into an internal combustion engine can be broadly categorized into two main groups:

Low Pressure Carburetted Induction or Manifold Based Injection:

The practice of inducting natural gas into the inlet of an internal combustion engine is well known and is similar to LPG fuelled vehicles. Because of the ignition characteristics of inspirited natural gas compared to direct injection diesel, the level of liquid fuel substitution when used in a diesel engine using low pressure carburetted induction/manifold based injection is somewhat limited. Another problem with this method is the 'methane slippage' that results from the overlap of the inlet and exhaust valves, and/or non-combustion zones in the cylinder chamber typically in the piston-land gap. This results in a level of unburnt hydrocarbons in the engine exhaust that can negate most of the greenhouse gas emission benefits of using natural gas.

High Pressure Direct Injection:

In the case of high pressure direct injection (HPDI), the natural gas is injected into the cylinder with a small quantity of pilot diesel fuel (typically between 3% and 5%) with the result that there is no little potential for methane slippage or pre-ignition of the fuel-air mix. As a result a diesel engine operating on natural gas with high pressure direct injection retains the benefit of the high efficiency of a diesel engine, is able to achieve better than 95% displacement of the liquid fuel, and achieves significant reductions in greenhouse gas emissions and pollutants including sulphur dioxide, carbon dioxide, oxides of nitrogen and soot. Thermal tip ignition or spark ignition are alternatives to diesel pilot ignition and results in a 100 percent gas direct injection engine.

However, HPDI requires the natural gas to be supplied to the engine at a consistent high pressure (typically greater than 3000 psi). For LNG this is achieved through the use of a specially designed pump capable of operating at cryogenic temperatures and delivering the fuel at the required pressure. For CNG it requires an expensive and complex gas compressor that must deliver natural gas at the required pressure from a range of pressures typically between 10 psi (near empty CNG tank) and 3600 psig (full CNG tank). This means the gas compressor set must have the capability to reject the significant quantities of heat created by a compression ratio of up to 300:1 in order to full utilise a tank of CNG. Alternatively a significant amount of fuel is left within the tank to limit the gas compression ratio. This requires large air to gas intercoolers, consumes large quantities of energy and requires a large amount of space which is something not available on most vehicles. While LNG has had some success as a liquid fuel replacement in some regions of the world, the lack of availability of LNG and its high cost means that in many regions of the world it is not feasible to use LNG.

In the case of CNG, it also has had some success as a liquid fuel replacement but almost exclusively in spark ignition engines utilising the low pressure carburetted/port injection induction technology. This application is popular in government bus fleets around the world where the cleaner burning natural fuel is used in a spark ignition engine to replace a conventional diesel engine.

The availability of a system to maintain a high CNG pressure for direct injection means that high horse power CNG has not been considered practical and many in the field have pursued LNG as the only viable natural gas fuel that can be readily pumped/maintained at a high pressure as a liquid to meet the pressure requirements of direct injection.

CNG also has significant issues with transfer of CNG from fixed storage to a vehicle. These issues involve the generation of excessive heat during transfer which limits fill capacity. Further, the fixed storage pressure varies limiting its ability to refuel.

OBJECT OF THE INVENTION

It is an object of the invention to overcome and/or alleviate one or more of the above disadvantages or provide the consumer with a useful or commercial choice.

SUMMARY OF THE INVENTION

In one form, although not necessarily the only or broadest form, the invention resides in a compressed gas transfer system comprising:

at least one first pressure vessel able to hold a volume of gas; and a first gas line to allow gas to pass out of the at least one first pressure vessel;

wherein the volume of the first pressure vessel is able to be varied to maintain gas within the pressure vessel at a constant pressure.

The compressed gas transfer system may include a plurality of first pressure vessels.

Normally, the first gas line is connected to a gas consuming device. Preferably, the gas consuming device is a vehicle combustion engine.

Preferably, the compressed gas transfer system includes a first liquid delivery line connected to the at least one first pressure vessel and a first pump located within the first liquid delivery line, the first pump able to pump liquid into the first pressure vessel via the first liquid delivery line to vary the volume of the at least one first pressure vessel.

Preferably, the compressed gas transfer system includes a first liquid reservoir to hold a volume of liquid, the first liquid reservoir connected to the first liquid delivery line.

Preferably, the compressed gas transfer system includes a first liquid return line that extends between the first liquid reservoir and the at least one first pressure vessel.

Preferably, the volume of the liquid in the first reservoir is greater than the volume of a single first pressure vessel but less than the volume of the plurality of the first pressure vessels.

Preferably, the liquid is water. The water may contain salt.

Preferably, the compressed gas transfer system wherein the first gas line is attached to a refuelling system. It should be appreciated that the refuelling system may include a both storage and/or refuelling modules.

Preferably, the refuelling system includes at least one second pressure vessel able to hold a volume of gas and a second gas line connected to the at least one second pressure vessel wherein the volume of the second pressure vessel is able to be varied to maintain the volume of gas within the second pressure vessel at a constant pressure when gas is passing from the second pressure vessel through the second gas line.

Preferably, the compressed gas transfer system includes a second liquid delivery line connected to the at least one second pressure vessel and a second pump located within the second liquid delivery line, the second pump able to pump liquid into the second pressure vessel via the second liquid delivery line to vary the volume of the at least one second pressure vessel.

Preferably, the compressed gas transfer system includes a second liquid reservoir to hold a volume of liquid, the second liquid reservoir connected to a second liquid delivery line.

Preferably, the compressed gas transfer system includes a second liquid return line extends between the second liquid reservoir and at least one second pressure vessel.

A method of transferring compressed gas including the step of varying the volume of an at least one first pressure vessel to maintain a volume of gas within the pressure vessel at a constant pressure.

The method may include the step of pumping a liquid through a first liquid delivery line connected to the at least one first pressure vessel vary the volume of the at least one first pressure vessel.

The method may include the step of pumping liquid into at least one second pressure vessel to transfer gas at a constant pressure from the at least one second pressure vessel into the at least one first pressure vessel.

BRIEF DESCRIPTION OF THE DRAWINGS

An embodiment of the invention will be described with the reference to the accompany drawings in which.

DETAILED DESCRIPTION OF THE PREFERRED EMBODIMENT

Figure 1:
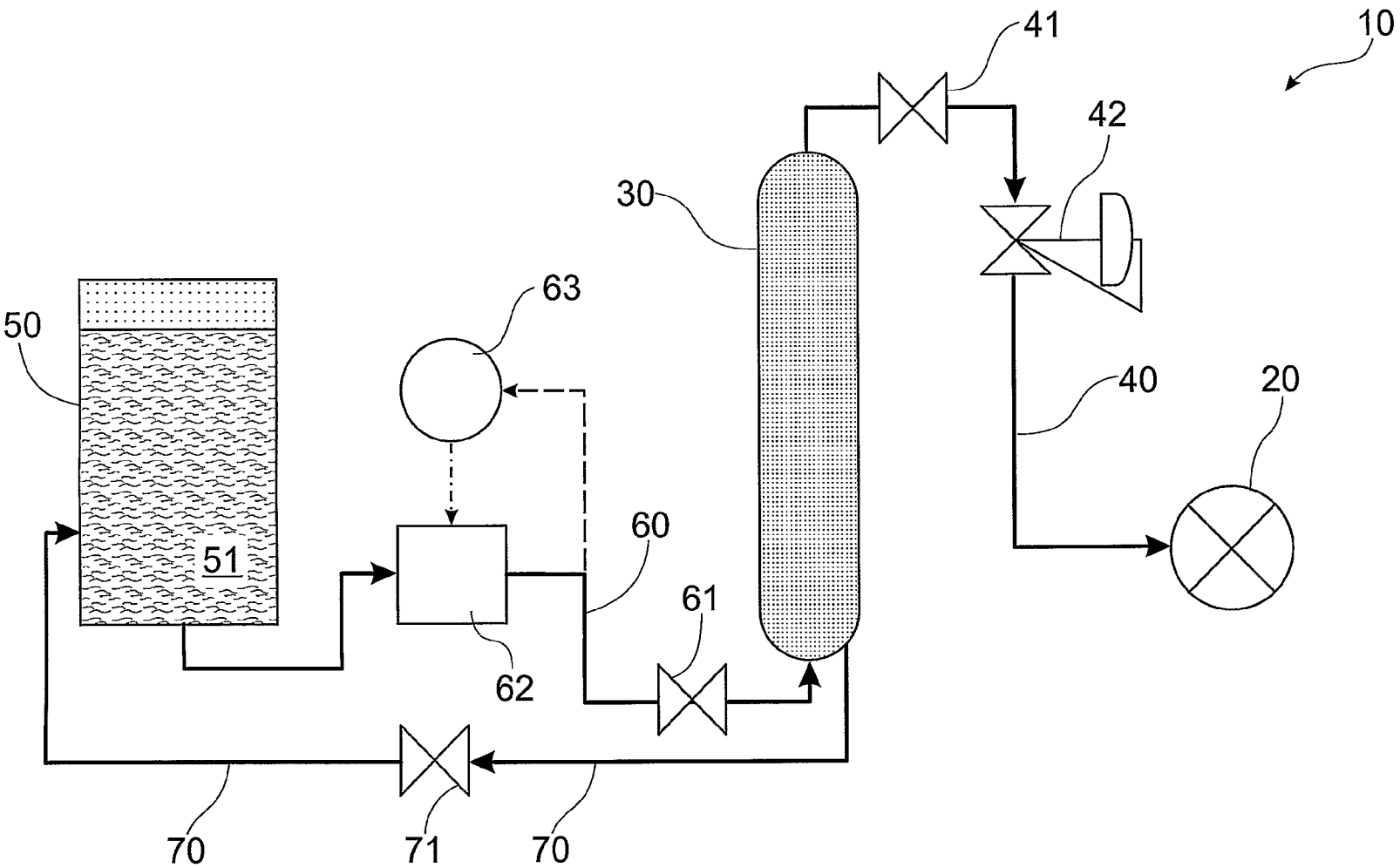
FIG. 1 is a schematic view of a compressed natural gas transfer system at rest according to a first embodiment of the invention.
Figure 2:
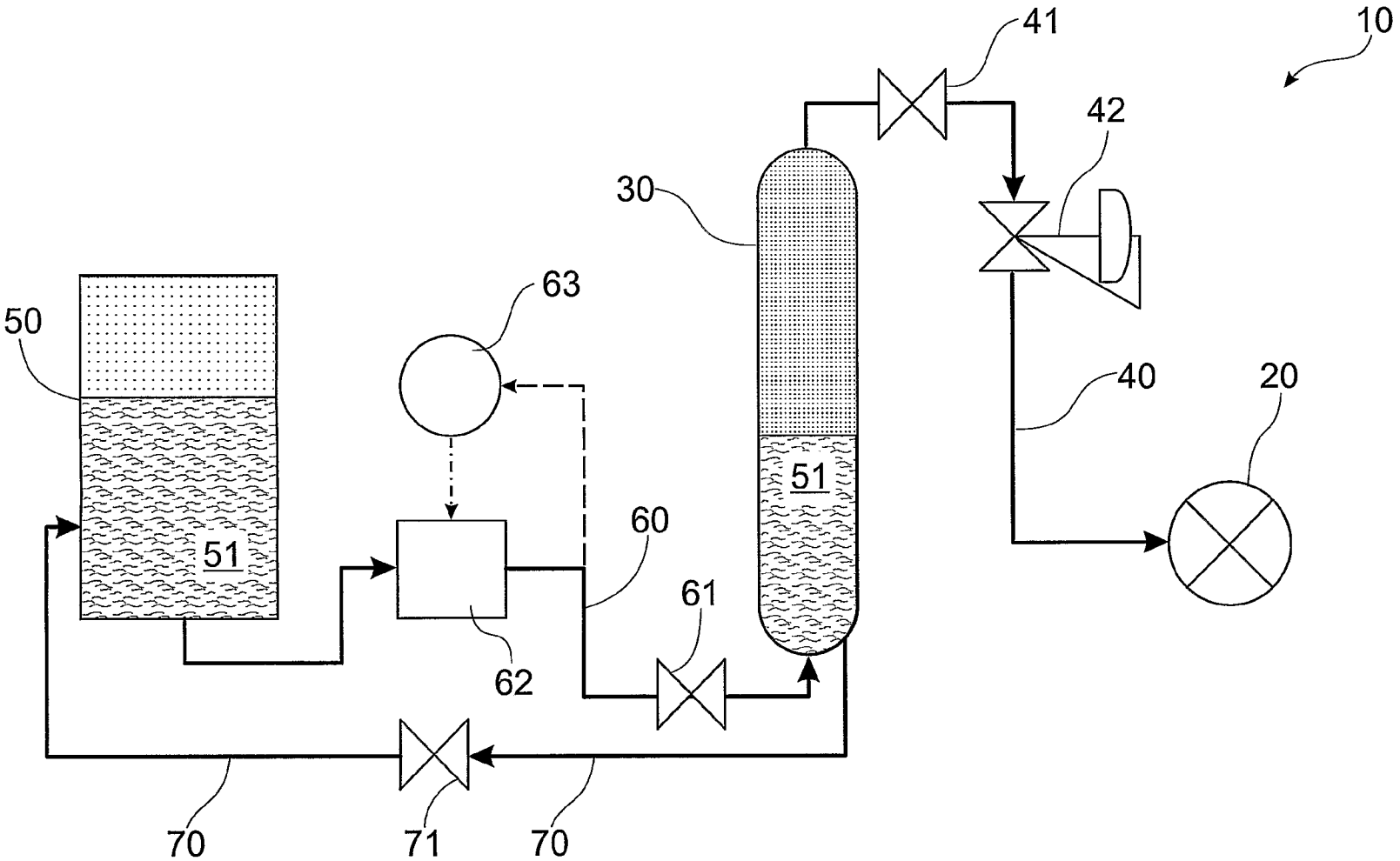
FIG. 2 is a schematic view of the compressed natural gas transfer system of FIG. 1 supplying compressed natural gas at a pre-determined pressure according to an embodiment of the invention.
Figure 3:
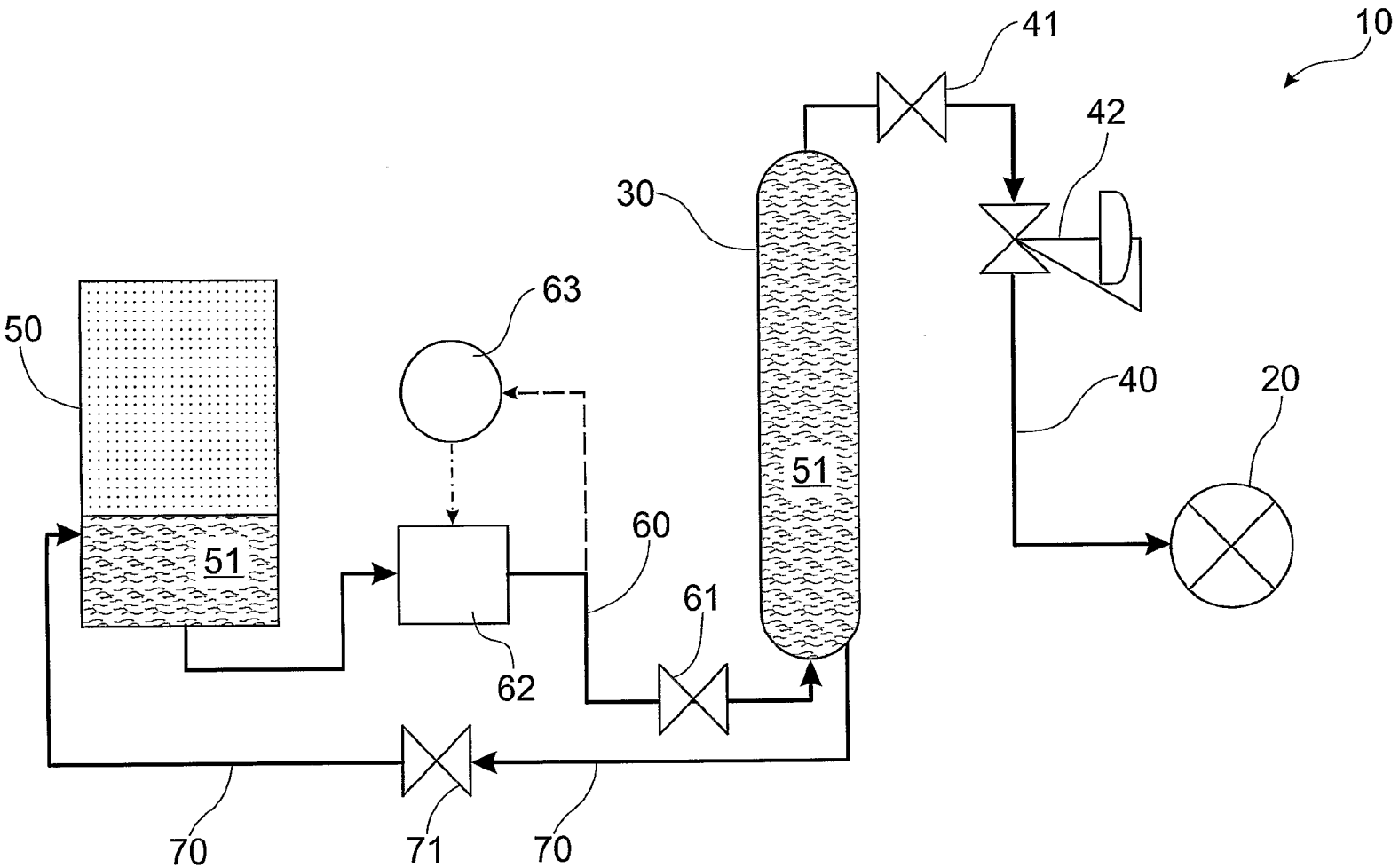
FIG. 3 is a schematic view of the compressed natural gas transfer system of FIG. 1 having completed supply of compressed natural gas according to an embodiment of the invention.

FIGS. 1 to 3 show a compressed natural gas transfer system 10 which includes supplying gas at high pressure to a gas consuming device 20. The gas consuming device is typically in the form of a vehicle engine and accordingly the transfer system 10 is usually portable. However, the transfer system 10 may be stationary and supply a gas consuming device in the form of a gas turbine or any plant or process requiring a relatively constant stream of high pressure gas.

The compressed natural gas transfer system 10 includes an engine module pressure vessel 30 in the form of a tank. The engine module pressure vessel 30 is able to cater for different pressures as required. However, current pressure technology would reasonably allow operating pressures up to a maximum of 3000 to 5000 psi. This maximum range is typical of the pressure at which compressed natural gas is supplied to an engine module in a high pressure direct injection system. However, it should be appreciated that the rating and operating pressure of the engine module pressure vessel 30 can be varied depending upon the requirements of the gas consuming device 20.

An engine module gas line 40 is used to connect the engine module pressure vessel 30 to the gas consuming device 20. An engine module gas valve 41 is used to isolate the supply of gas from the engine module pressure vessel 30 from the gas consuming device 20 through the engine module gas line 40. An engine module gas pressure control valve 42 is located within the engine module gas line 40 to ensure that the gas that is supplied to the gas consuming device 20 is supplied at a relatively constant desired pressure.

An engine module liquid reservoir 50 is connected to the engine module pressure vessel 30 via an engine module liquid delivery line 60 and an engine module liquid return line 70. The engine module liquid reservoir 50 is filled with liquid 51. The liquid 51 is typically water with salt being added to the water in low temperature environments. An engine module liquid inlet valve 61 is used to permit the delivery of liquid 51 from the engine module liquid reservoir 50 to the engine module pressure vessel 30 through the engine module liquid delivery line 60. An engine module liquid outlet valve 71 is used to allow liquid 51 to return from the engine module pressure vessel 30 through the engine module liquid return line 70.

An engine module reservoir pump 62 is located within the liquid delivery line 60 to pump liquid 51 from the engine module liquid reservoir 50 to the engine module pressure vessel 30. An engine module reservoir pump pressure controller 63 is connected to the engine module reservoir pump 62 and the engine module liquid delivery line 60 to ensure the desired pressure with the engine module pressure vessel 30 is maintained. The amount of liquid 51 being delivered to the engine module pressure vessel 30 can be controlled by using the engine module reservoir pump 62 that is either a variable speed pump, a variable displacement pump, a constant speed pump with spill valves or a combination thereof.

In use, the engine module pressure vessel 30 is filled with gas to a desired pressure as shown in FIG. 1 and remains at rest until the operation of gas consuming device 20 is required. At this point, as shown in FIG. 2, the engine module gas valve 41 and the engine module liquid inlet valve 61 are opened and operation of the engine module reservoir pump 62 is commenced. Liquid 51 is moved by the engine module reservoir pump 62 through the engine module liquid delivery line 60 into the engine module pressure vessel 30 at a flow rate that maintains relatively constant pressure of the gas within the engine module pressure vessel 30. The rate of flow of the liquid 51 into the engine module pressure vessel 30 is controlled by the engine module reservoir pump pressure controller 63. The gas flows from the engine module pressure vessel 30 through the engine module gas pressure control valve 42 and is consumed by the gas consuming device 20.

When the majority of the gas located within the engine module pressure vessel 30 has been consumed by the gas consuming device 20, the operation of the engine module reservoir pump 62 is ceased and the engine module gas valve 41 and engine module liquid inlet valve 61 are closed as shown in FIG. 3.

Figure 4:
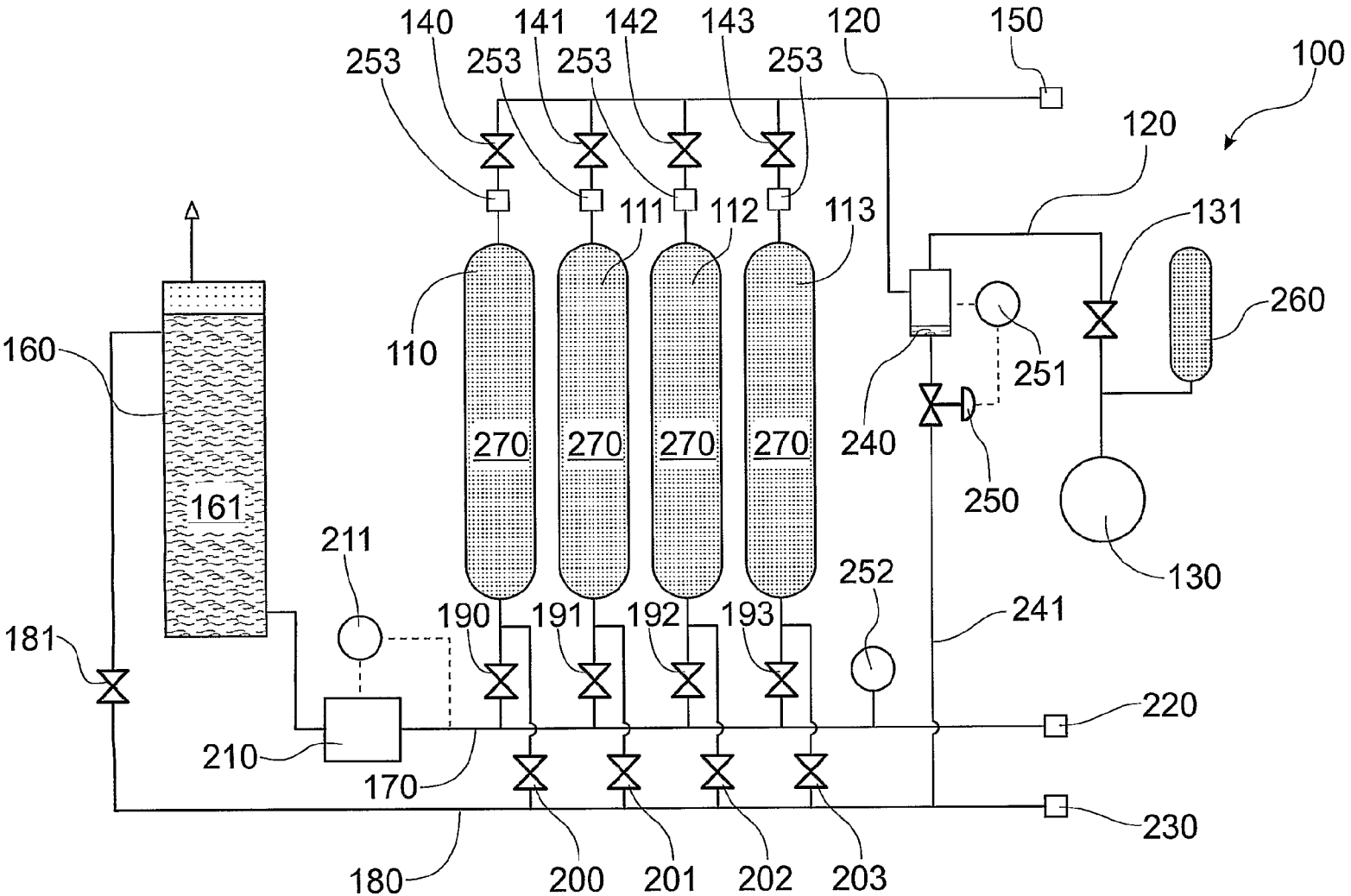
FIG. 4 is a schematic view of a compressed natural gas transfer system at rest according to a second embodiment of the invention.

FIG. 4 shows a schematic view of a further compressed natural gas transfer system 100 for supplying gas to a combustion engine in which multiple engine module pressure vessels are utilised. This embodiment substantially reduces the liquid required by volume of gas and makes the system very amenable to use in vehicles.

The compressed natural gas transfer system 100 includes four engine module pressure vessels 110, 111, 112, 113 in the form of tanks. These engine module pressure vessels 110, 111, 112, 113, are of similar format to the engine module pressure vessel 30 described previously.

An engine module gas line 120 is used to connect the engine module pressure vessels 110, 111, 112, 113 to the engine 130. Engine module gas valves 140, 141, 142, 143 are located within the engine module gas line 120 with each engine module pressure vessel 110, 111, 112, 113 having an associated engine module gas valve 140, 141, 142, 143. A gas refuelling module connection 150 is attached to the engine module gas line 120 in order to refill the engine module pressure vessels 110, 111, 112, 113 with gas. Refuelling of the engine module pressure vessels 110, 111, 112, 113 with gas 270 will be described in further detail below.

An engine module liquid reservoir 160 is connected to the engine module pressure vessels 110, 111, 112, 113 via an engine module liquid delivery line 170 and an engine module liquid return line 180. The engine module liquid reservoir 160 is filled with liquid 161. The liquid 161 is typically water with salt being added to the water in low temperature environments. Engine module liquid inlet valves 190, 191, 192, 193 are used to permit the delivery of liquid 161 from the engine module liquid reservoir 160 to the engine module pressure vessels 110, 111, 112, 113 through the engine module liquid delivery line 170. Engine module liquid outlet valves 200, 201, 202, 203 are used to allow liquid 161 to return from the engine module pressure vessels 110, 111, 112, 113 through the engine module liquid return line 180.

An engine module reservoir pump 210 is located within the engine module liquid delivery line 170 to pump the liquid 161 from the engine module liquid reservoir 160 to the engine module pressure vessels 110, 111, 112, 113. It should be appreciated that the volume of liquid being supplied by the engine module reservoir pump 210 varies according to the consumption requirement of the engine 130. An engine module reservoir pump pressure controller 211 is connected to the engine module reservoir pump 210 and the engine module liquid delivery line 170 to ensure the flow rate of liquid 161 supplied to the engine module pressure vessels 110, 111, 112, 113 is controlled to maintain a relatively constant pressure in the engine module pressure vessel from which gas is being transferred. The amount of liquid 161 being delivered to the engine module pressure vessels 110, 111, 112, 113 can be controlled by using the engine module reservoir pump 210 which is in the form of a variable speed pump, a variable displacement pump, a constant speed pump with spill valves or a combination thereof.

An engine module liquid return valve 181 is located within the engine module liquid return line 180 to allow liquid 161 to pass along the engine module liquid return line 180 into the engine module liquid reservoir 160. Engine module liquid refuelling module connections 220 and 230 are provided on both the engine module liquid return line 180 and the engine module liquid delivery line 170 respectively. The operation of these engine module liquid refuelling module connections 220 and 230 will be described in greater detail below.

An engine module liquid gas separator 240 is located within the engine module gas line 120 to separate any liquid 161 that may be supplied with the gas 270 from the engine module pressure vessels 110, 111, 112, 113. An engine module separator return line 241 is connected from a base of the engine module liquid gas separator 240 to the engine module liquid return line 180. An engine module level control valve 250 is located within the engine module separator liquid return line 241 and is operated by an engine module level switch 251 to release liquid 161 from the engine module liquid gas separator 240 when the level of liquid 161 within the engine module liquid gas separator 240 has reached a predetermined level. Operation of engine module level switch 251 is used to determine that the engine module pressure vessel supplying gas is full of liquid and trigger the next stage of the operation.

It is envisaged that there are other methods of triggering the next stage of operation including the use of an engine module pressure transmitter 252 located within the engine module delivery line 170 that measures pressure spikes due to the high liquid viscosity relative to the gas. An engine module fluid operated obstructing device 253 may be located adjacent the top of the engine module pressure vessels 110, 111, 112, 113 to enhance the pressure spike by allowing gas to pass through the engine module fluid operated obstructing device 253 easily but restricting the flow of liquid 161 through the engine module fluid operated obstructing device 253.

An engine module high pressure gas accumulator 260 is located within the engine module gas line 120 in order to assist in supplying gas 270 to the engine 130 at a relatively constant pressure and to provide a small reserve of gas while the transfer system 100 transfers the supply of gas from one engine module pressure vessel to the subsequent engine module pressure vessel. An engine module gas shut off valve 131 is located within the gas line 120 adjacent the engine module high pressure gas accumulator 260.

In use, at the start of the cycle, the engine module pressure vessels 110, 111, 112, 113 all are filled with high pressure natural gas 270 and all of the engine module gas valves 140, 141, 142, 143 are in a closed position as shown in FIG. 4.

Figure 5:
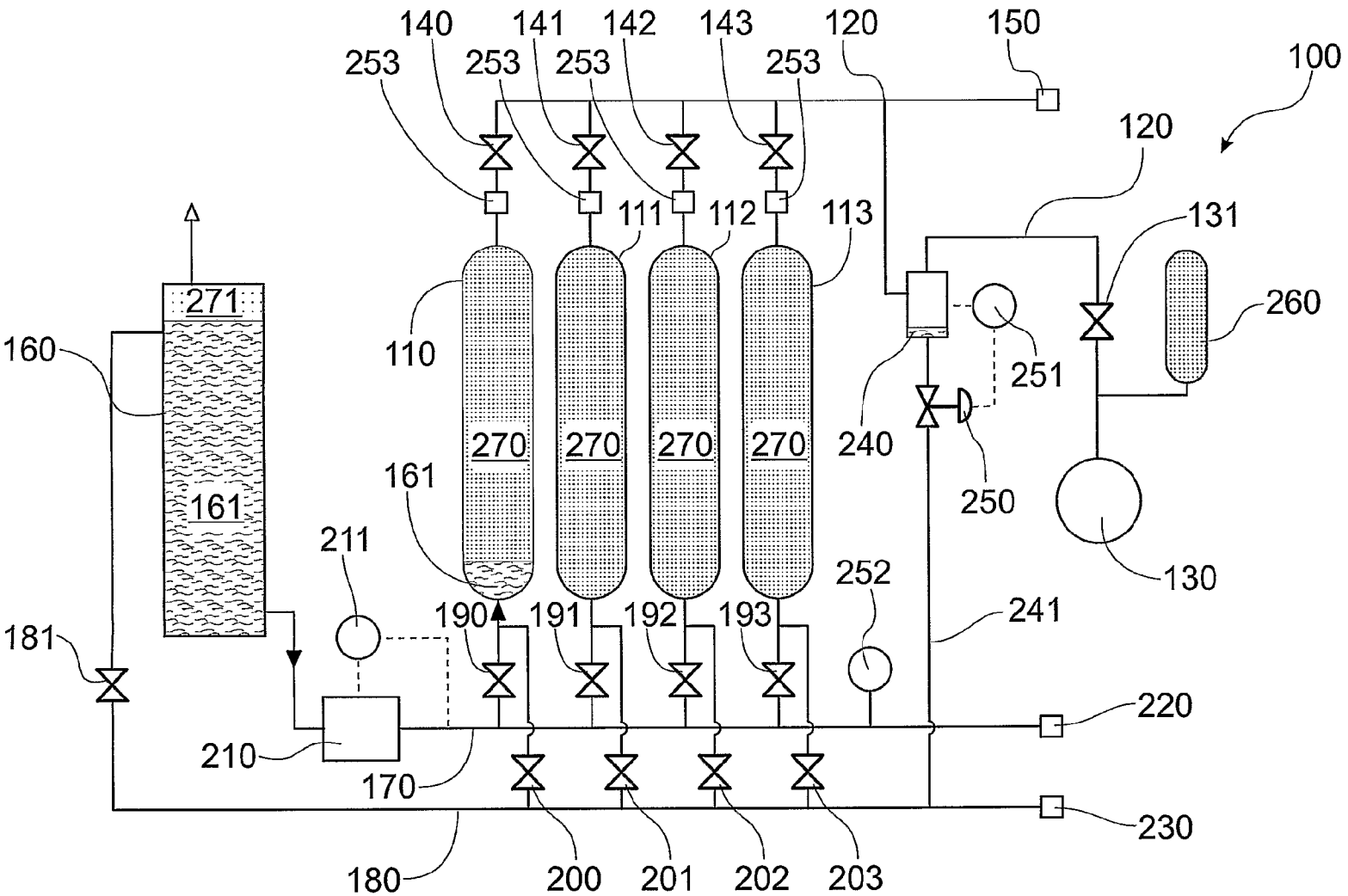
FIG. 5 is a schematic view of a compressed natural gas transfer system according to FIG. 4 supplying gas from a first engine pressure vessel.

FIG. 5 shows the commencement of operation of the engine module gas transfer system 100 in which a first engine module gas valve 140 for the first engine module pressure vessel 110 is opened. Simultaneously, the engine module gas shut off valve 131 is moved to the open position as is the first engine module liquid inlet valve 190 for the first engine module pressure vessel 110. The engine module reservoir pump 210 commences operation and pumps liquid 161 from the engine module liquid reservoir 160 through the engine module liquid delivery line 170 into the first engine module pressure vessel 110. This causes the gas 270 located within the first engine module pressure vessel 110 to pass into the engine module gas line 120 at pressure. The pressure located within the first engine module pressure vessel 110 is maintained at a relatively constant pressure as it passes gas 270 through the engine module gas line 120 to the engine 130.

Figure 6:
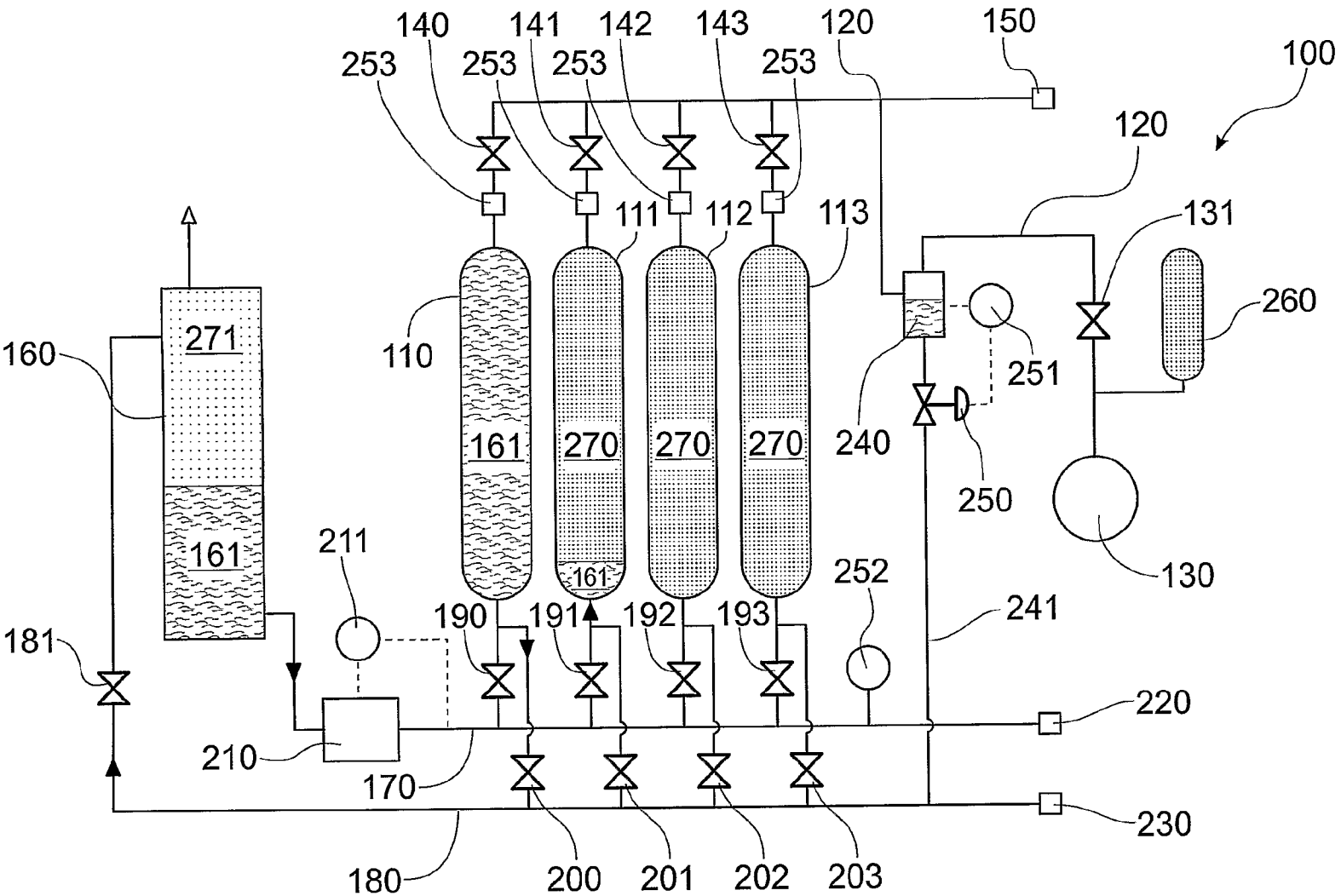
FIG. 6 is the schematic view of a compressed natural gas transfer system according to FIG. 4 having completed the gas transfer from the first engine pressure vessel and commencing supplying gas from a second engine pressure vessel.

The liquid 161 is continued to be pumped into the first engine module pressure vessel 110 until the first engine module pressure vessel 110 is full of liquid 161 as shown in FIG. 6. The liquid 161 flows through the engine module gas line 120 and into the engine module liquid gas separator 240 and activates the engine module level switch 251 and/or engine module pressure transmitter 252. At this stage, the first engine module gas valve 140 and the first engine module liquid inlet valve 190 are closed. At the same time, the second engine module gas valve 141 and second engine module liquid inlet valve 191 are opened so that liquid 161 is pumped from the engine module liquid reservoir 160 into the second engine module pressure vessel 111 to allow gas 270 to be passed into the engine module gas line 120 and to the engine 130 at a relatively constant pressure. The engine module high pressure gas accumulator 260 supplies gas to the engine 130 during this operation. The first liquid outlet valve 200 and the engine module liquid return valve 181 are then opened.

Figure 7:
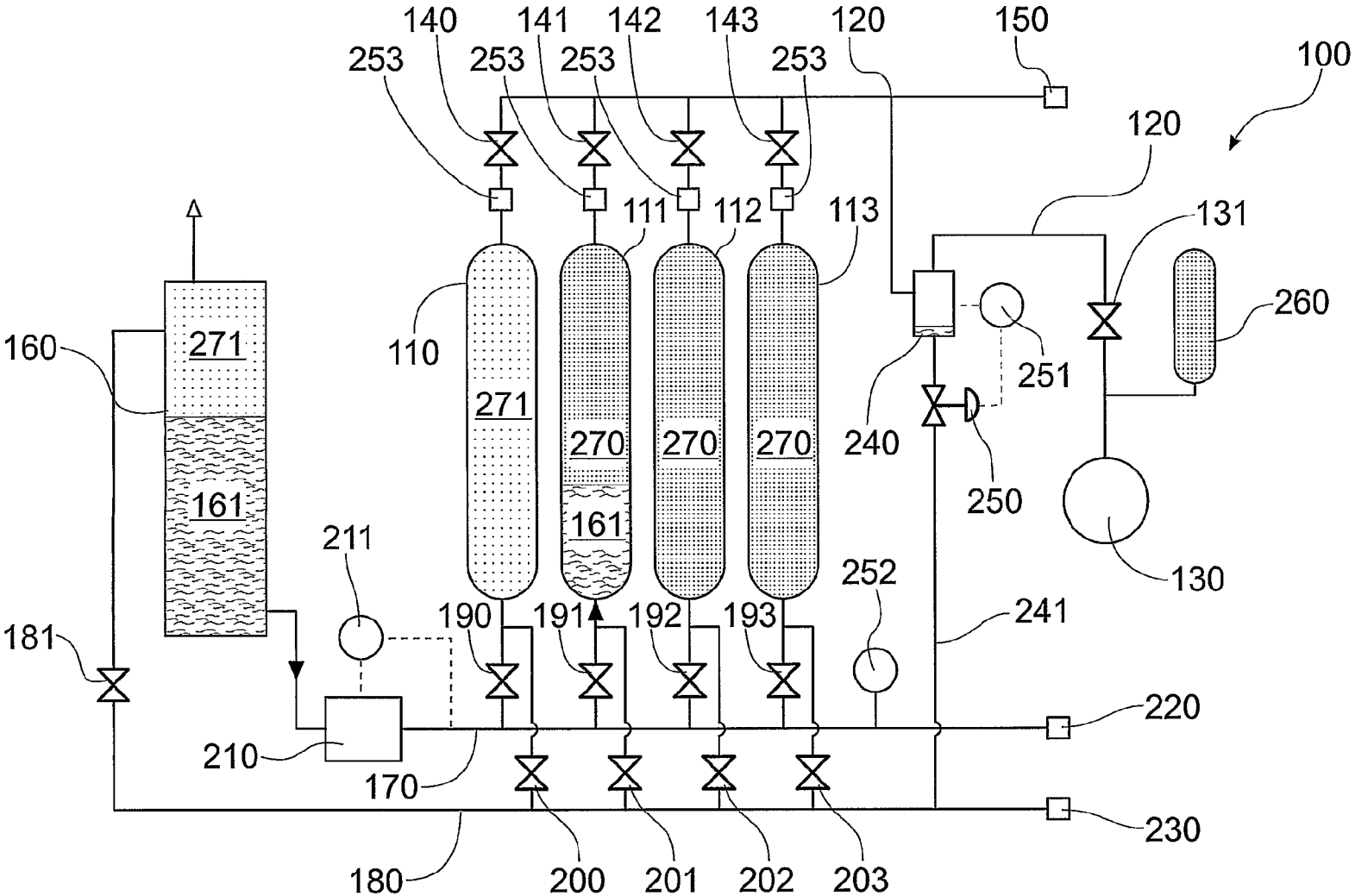
FIG. 7 is a schematic view of a compressed natural gas transfer system according to FIG. 4 in which gas has been released from liquid located within the first engine pressure vessel and the liquid returned to the liquid reservoir.

FIG. 7 shows the gas 270 being supplied to the engine 130 by the second engine module pressure vessel 111. Whilst this occurs, residual gas 271 located within the liquid 161 in the first engine module pressure vessel 110 is released and forces the liquid 161 through the first engine module liquid outlet valve 200 back into the engine module liquid reservoir 160. The first engine module liquid outlet valve 200 is then moved to the closed position.

Figure 8:
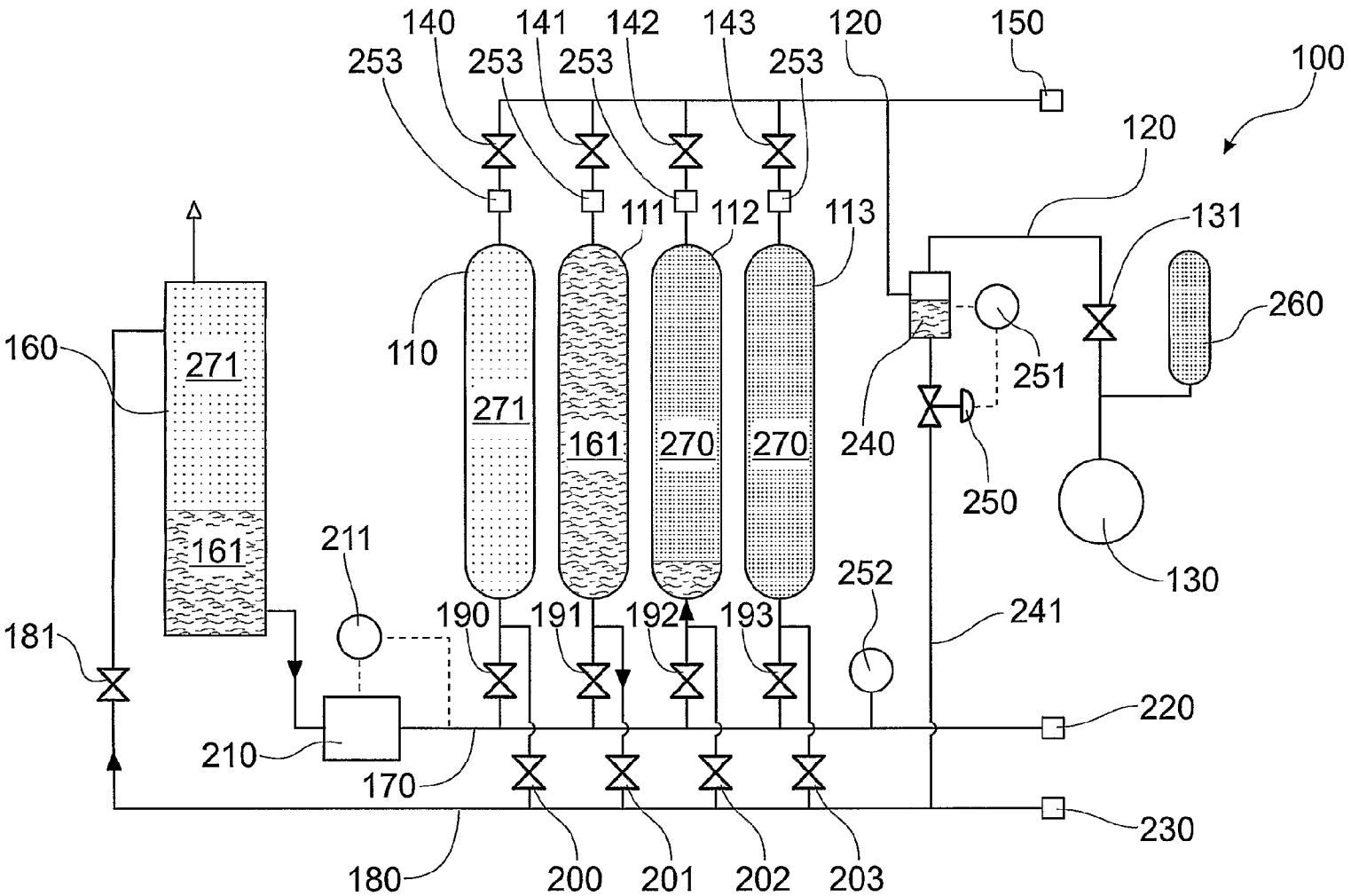
FIG. 8 is a schematic view of a compressed natural gas transfer system according to FIG. 4 having completed the gas transfer from the second engine pressure vessel and commencing supplying gas from a third engine pressure vessel.

The liquid 161 is pumped into the second engine module pressure vessel 111 until the second engine module pressure vessel 111 is full of liquid 161 as shown in FIG. 8. The liquid 161 flows through the engine module gas line 120 and into the engine module liquid gas separator 240 and activates the engine module level switch 251 and/or engine module pressure transmitter 252. At this point in the process, the second engine module gas valve 141 and the second engine module liquid inlet valve 191 are closed and the third engine module gas valve 142 and third engine module liquid inlet valve 192 are opened so that liquid 161 is pumped from the engine module liquid reservoir 160 into the third engine module pressure vessel 112 to allow gas 270 to be passed into the engine module gas line 120 and to the engine 130 at a relatively constant pressure. The engine module high pressure gas accumulator 260 supplies gas to the engine 130 during this operation. The second engine module liquid outlet valve 201 is then opened.

Figure 9:
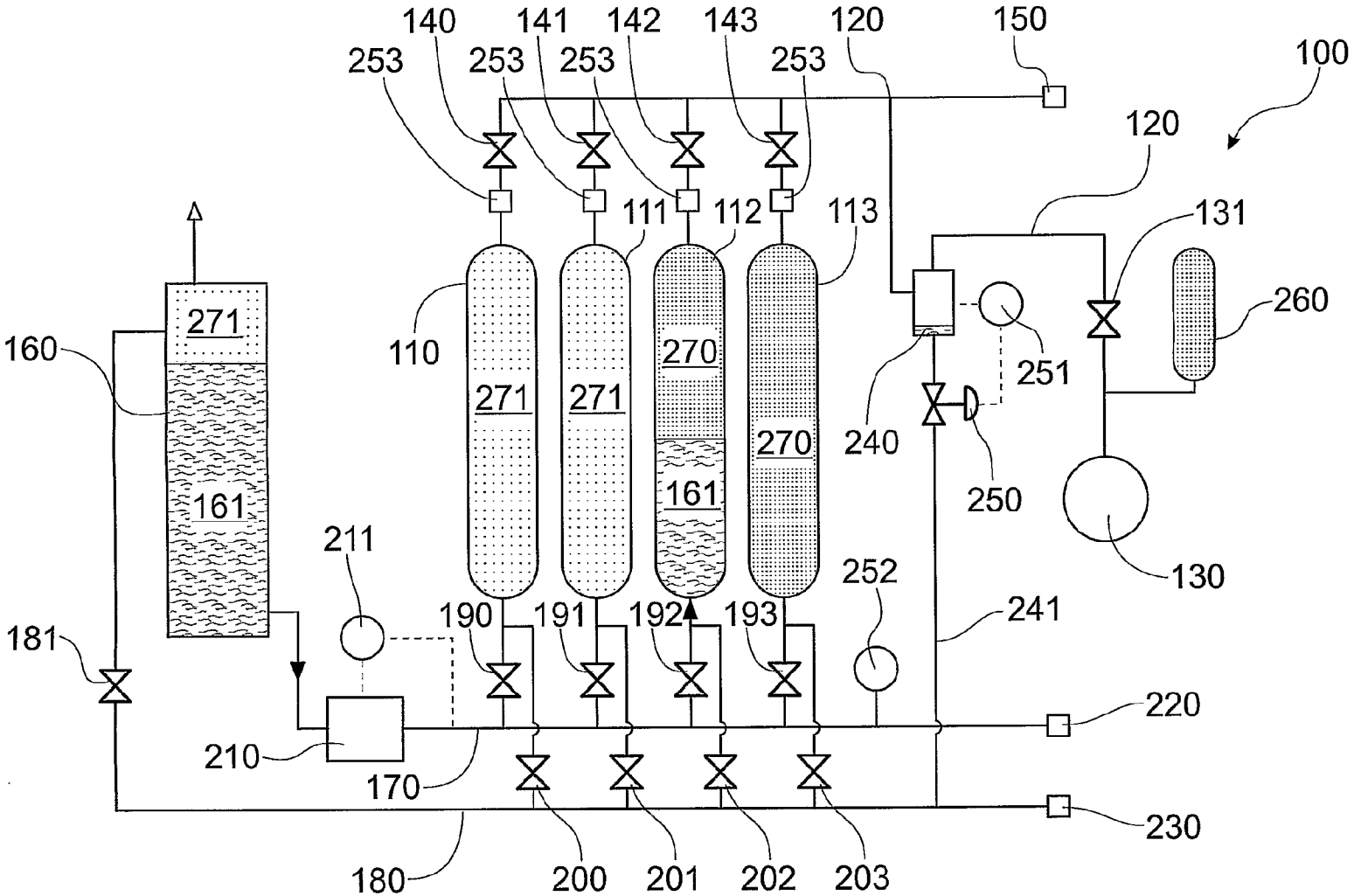
FIG. 9 is a schematic view of a compressed natural gas transfer system according to FIG. 4 in which gas has been released from liquid located within the second engine pressure vessel and the liquid returned to the liquid reservoir.

FIG. 9 shows the gas 270 being supplied to the engine 130 via the third engine module pressure vessel 113. Whilst this occurs, the residual gas 271 located within the liquid 161 in the second engine module pressure vessel 111 is released and forces the liquid 161 through the second engine module liquid outlet valve 201 back into the engine module liquid reservoir 160. The second engine module liquid outlet valve 201 is then moved to the closed position.

Figure 10:
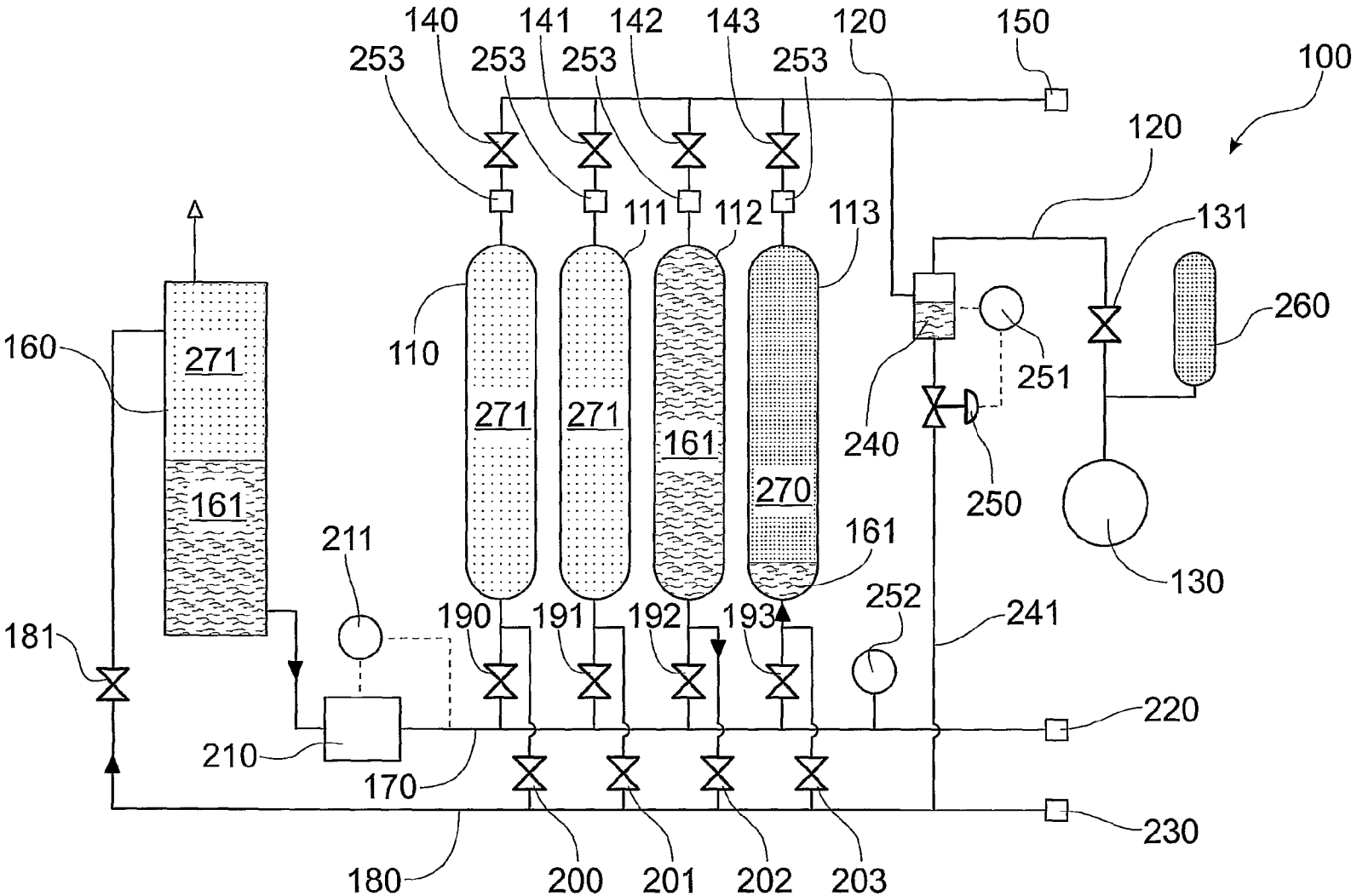
FIG. 10 is a schematic view of a compressed natural gas transfer system according to FIG. 4 having completed the gas transfer from the third engine pressure vessel and commencing supplying gas from a fourth engine pressure vessel.

Again, liquid 161 is continued to be pumped into the third engine module pressure vessel 112 until the third engine module pressure vessel 112 is full of liquid 161 as shown in FIG. 10. The liquid 161 flows through the gas line 120 and into the engine module liquid gas separator 240 and activates the engine module level switch 251 and/or pressure transmitter 252. The third engine module gas valve 142 and the third engine module liquid inlet valve 192 are then closed and the fourth engine module gas valve 143 and fourth engine module liquid inlet valve 193 are opened so that liquid 161 is pumped from the engine module liquid reservoir 160 into the fourth engine module pressure vessel 113 to allow gas 270 to be passed into the gas line 120 and to the engine 130 at a relatively constant pressure. The engine module high pressure gas accumulator 260 supplies gas 270 to the engine 130 during this operation. The third engine module liquid outlet valve 202 is then opened.

Figure 11:
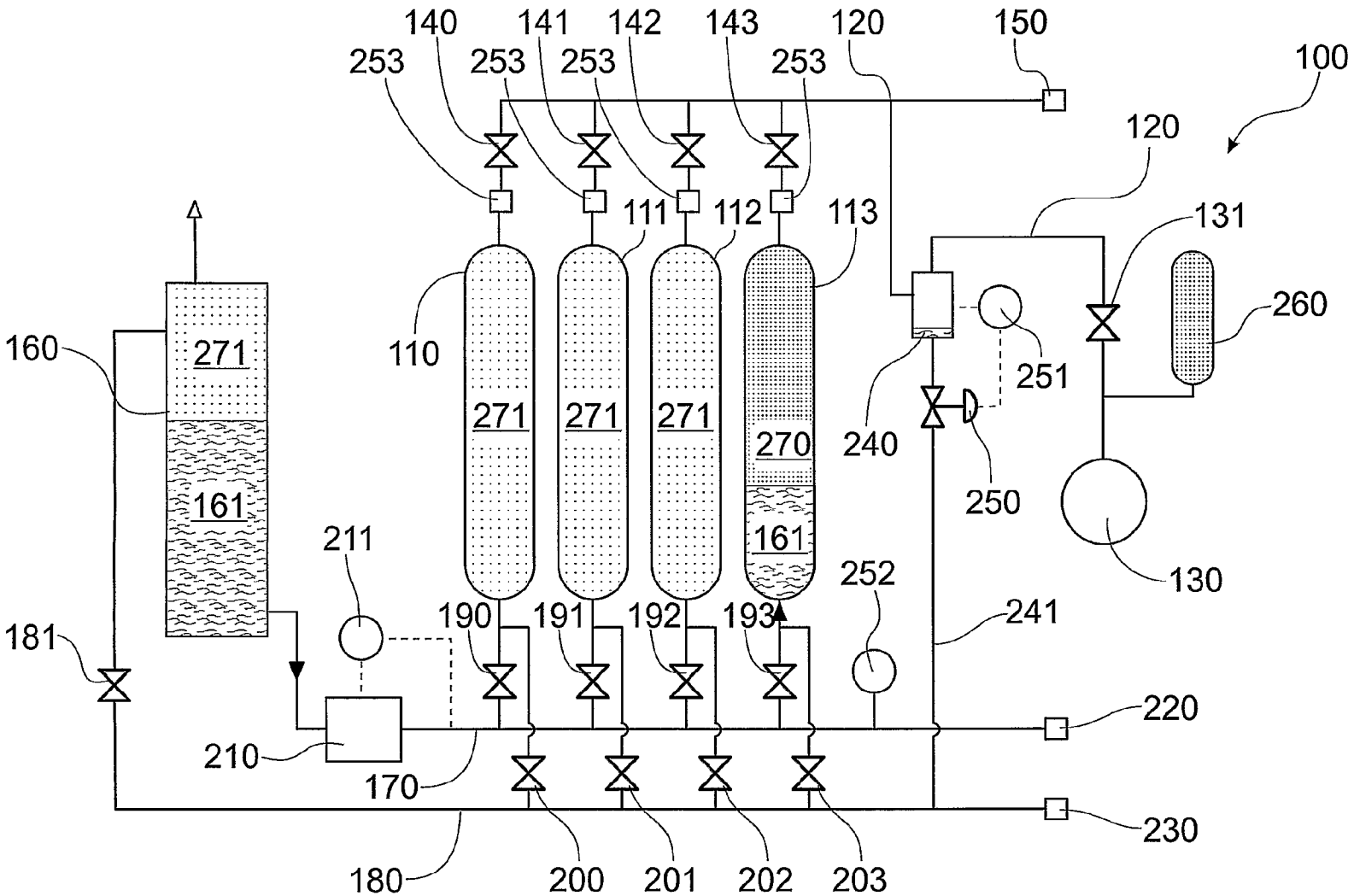
FIG. 11 is a schematic view of a compressed natural gas transfer system according to FIG. 4 in which gas has been released from liquid located with the third engine pressure vessel and the liquid returned to the liquid reservoir.

FIG. 11 shows whilst the gas 270 is being supplied to the engine 130 via the fourth engine module pressure vessel 113, the residual gas 271 located within the liquid 161 in the third engine module pressure vessel 112 is released and forces the liquid 161 through the third engine module liquid outlet valve 202 back into the engine module liquid reservoir 160. The third engine module liquid outlet valve 202 is then moved to the closed position.

Figure 12:
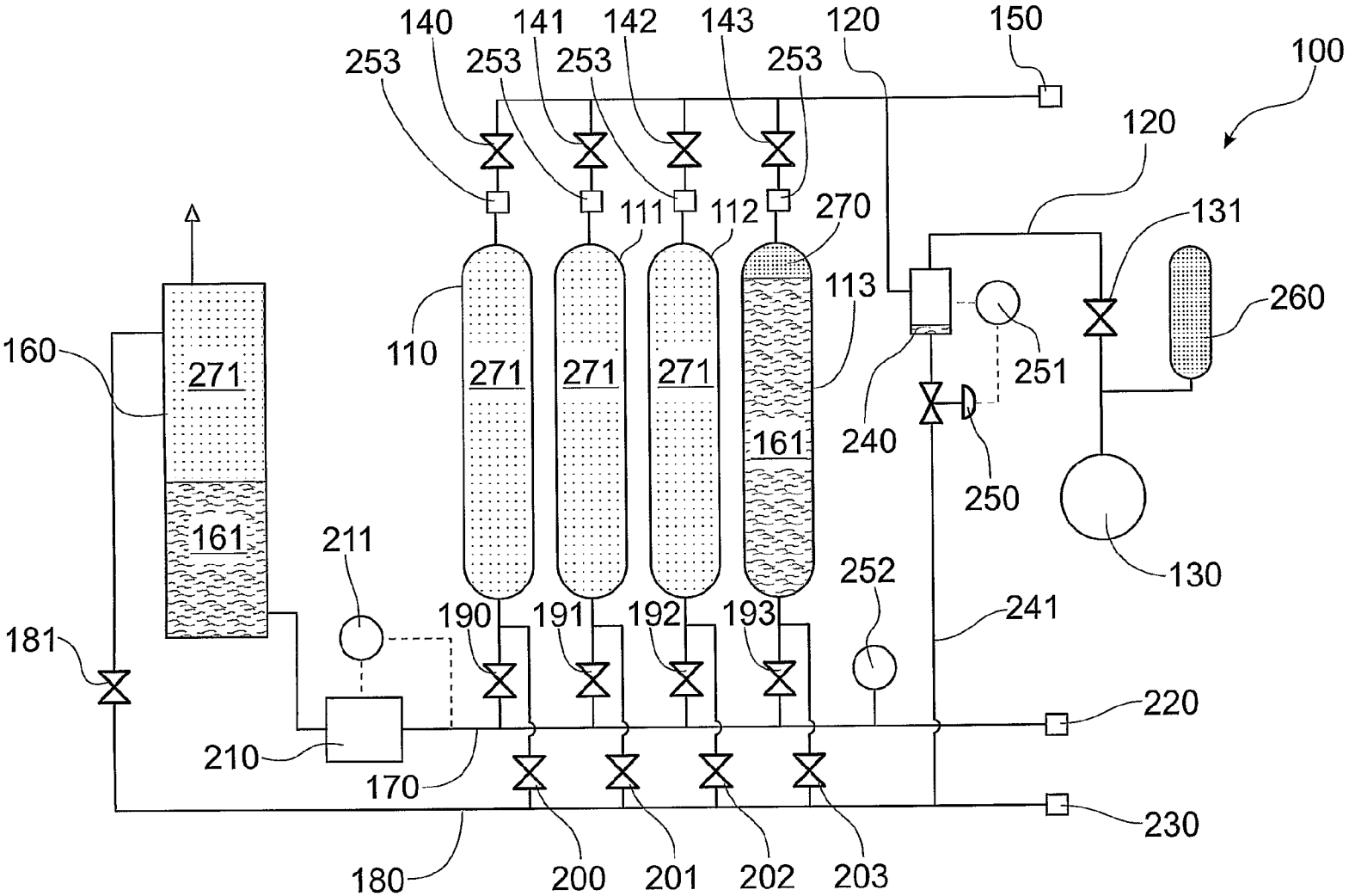
FIG. 12 is a schematic view of a compressed natural gas transfer system according to FIG. 4 completing supply of gas from the fourth engine pressure vessel.

Liquid 161 is pumped into the fourth engine module pressure vessel 113 until the fourth engine module pressure vessel 113 is approaching the point where it is full of liquid 161 and almost empty of gas 270 as shown in FIG. 12. As engine module pressure vessels 110, 111, 112, now contain only residual low pressure gas 271 and engine module pressure vessel 112 is almost empty of gas 270, the engine module pressure vessels must be refilled with high pressure gas 270 before the engine 130 can be operated again. A refuelling module 300 is used for this purpose.

Figure 13:
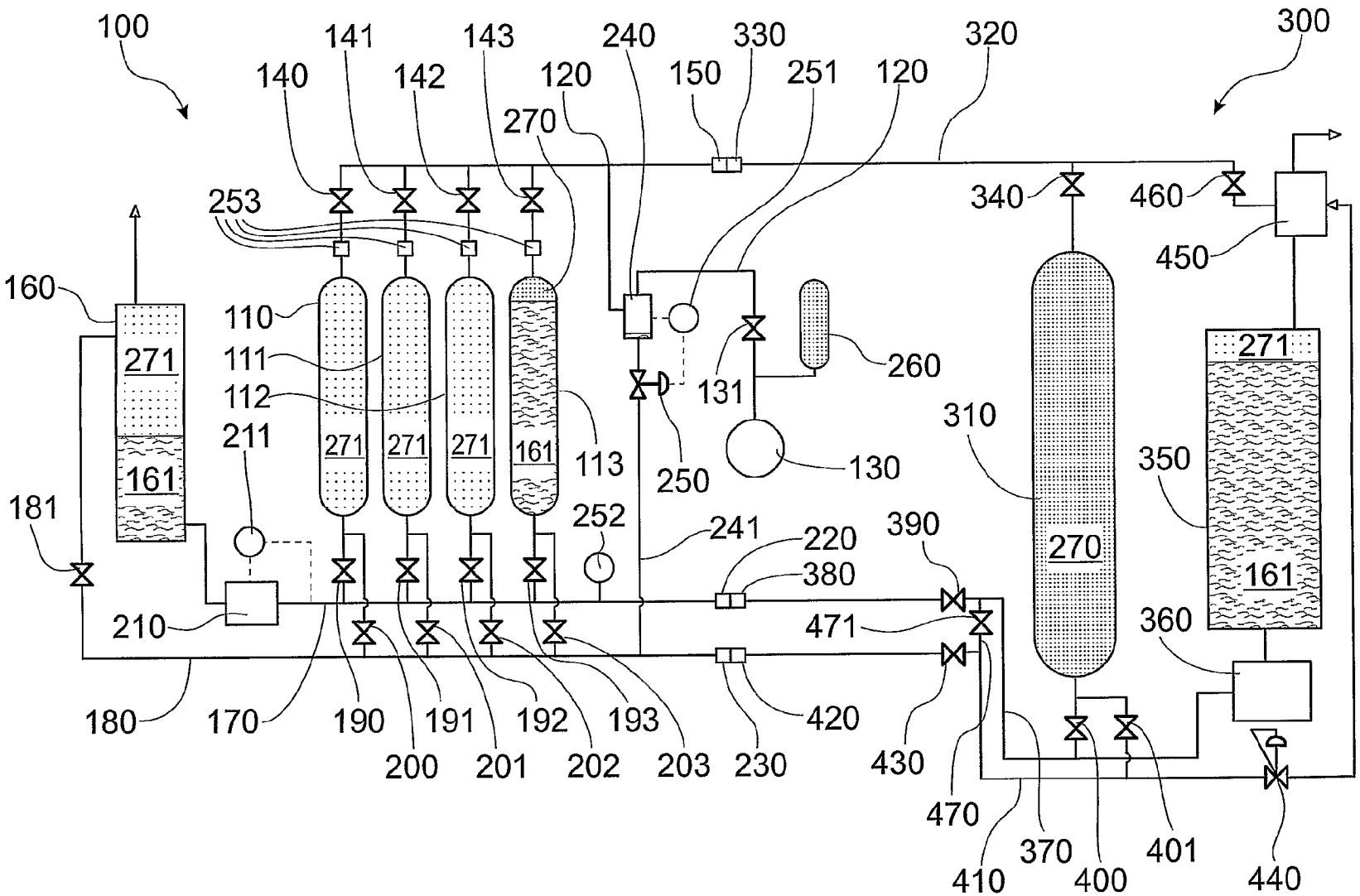
FIG. 13 is a schematic view of a compressed natural gas transfer system according to FIG. 4 connected to a refuelling system.

FIG. 13 shows the compressed natural gas transfer system 100 also including a refuelling module 300 for refuelling the engine module pressure vessels 110, 111, 112, 113 with gas 270. The gas refuelling module 300 includes a refuelling module pressure vessel 310 which is filled with a large volume of gas 270 at high pressure. The refuelling module pressure vessel 310 is connected to a refuelling module gas line 320 which is connected to the gas transfer system 100 via a refuelling module gas connection 330. A refuelling module gas valve 340 can be moved between an open and a closed position to allow gas 270 to pass from the refuelling module pressure vessel 310 into the refuelling module gas line 320.

The refuelling module 300 also includes a refuelling module liquid reservoir 350. The refuelling module liquid reservoir 350 includes the same liquid 161 as the engine module liquid reservoir 160 of the gas transfer system 100. The refuelling module liquid reservoir 350 is connected to a refuelling module pump 360 which is connected to a refuelling module liquid transfer line 370. The refuelling module liquid transfer line 370 is connected to the gas transfer system 100 via a refuelling module liquid transfer coupling 380. A refuelling module liquid transfer valve 390 is located within the refuelling module liquid transfer line 370. The refuelling module liquid transfer line 370 is connected to the refuelling module pressure vessel 310 via a refuelling module liquid inlet valve 400.

A refuelling module liquid return line 410 is connected to the gas transfer system 100 via a refuelling module liquid return coupling 420. A refuelling module liquid return valve 430 controls the flow of liquid 161 through the refuelling module liquid return line 410 to the refuelling module liquid reservoir 350. The refuelling module liquid return line 410 is also connected to the refuelling module pressure vessel 310 via a refuelling module liquid outlet valve 401. The refuelling module liquid return line 410 includes a refuelling module pressure control valve 440 so that liquid 161 in the engine module pressure vessels 110, 111, 112, 113 is maintained at a relatively constant high pressure while the gas 270 is transferred through refuelling module gas refuelling module line 320 into the engine module pressure vessels 110, 111, 112 & 113.

The refuelling module liquid return line 410 is connected to a refuelling module gas liquid separator 450. The refuelling module gas liquid separator 450 is connected to both the refuelling module liquid reservoir 350 and a vapour recovery system (not shown). The refuelling module gas line 320 is also connected to the refuelling module gas liquid separator 450 via a refuelling module gas vent valve 460. The refuelling module liquid transfer line 370 and the refuelling module liquid return line 410 are interconnected by a refuelling module intermediate line 470 via a refuelling module intermediate valve 471.

Figure 14:
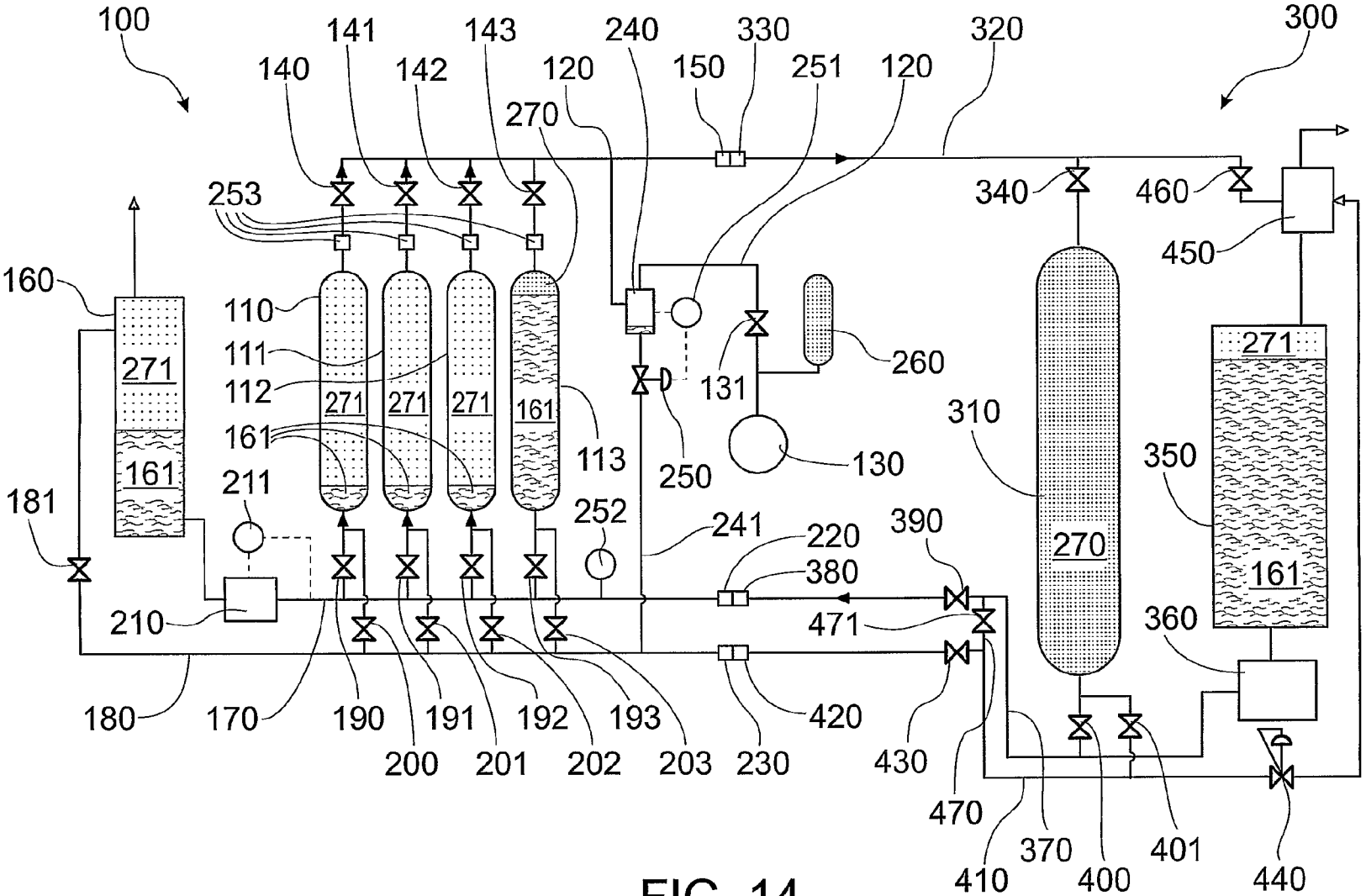
FIG. 14 is a schematic view of a compressed natural gas transfer system according to FIG. 4 in which the first three engine pressure vessels are being filled with liquid from the refuelling system.

In order to refuel the gas transfer system 100, the refuelling module pump 360 is switched on, the refuelling module liquid transfer valve 390 and the refuelling module gas vent valve 460 are opened, the first engine module gas valve 140, the second engine module gas valve 141 and the third engine module gas valve 142 are opened and the first engine module liquid inlet valve 190, second engine module liquid inlet valve 191 and third engine module liquid inlet valve 192 are also opened. Liquid 161 is therefore able to flow through the refuelling module liquid transfer line 370 from the refuelling module liquid reservoir 350. The liquid 161 is transferred into the engine module liquid delivery line 170 of the gas transfer system 100 and into the first engine module pressure vessel 110, second engine module pressure vessel 111 and third engine module pressure vessel 112 as shown in FIG. 14. This causes the residual gas 271 located within the first engine module pressure vessel 110, second engine module pressure vessel 111 and third engine module pressure vessel 112 to pass into the gas line 120 of the gas transfer system 100 and into the refuelling module gas line 320 of the refuelling module system 300, through the refuelling module gas liquid separator 450 where it can be recovered in a known vapour recovery system (not shown).

Figure 15:
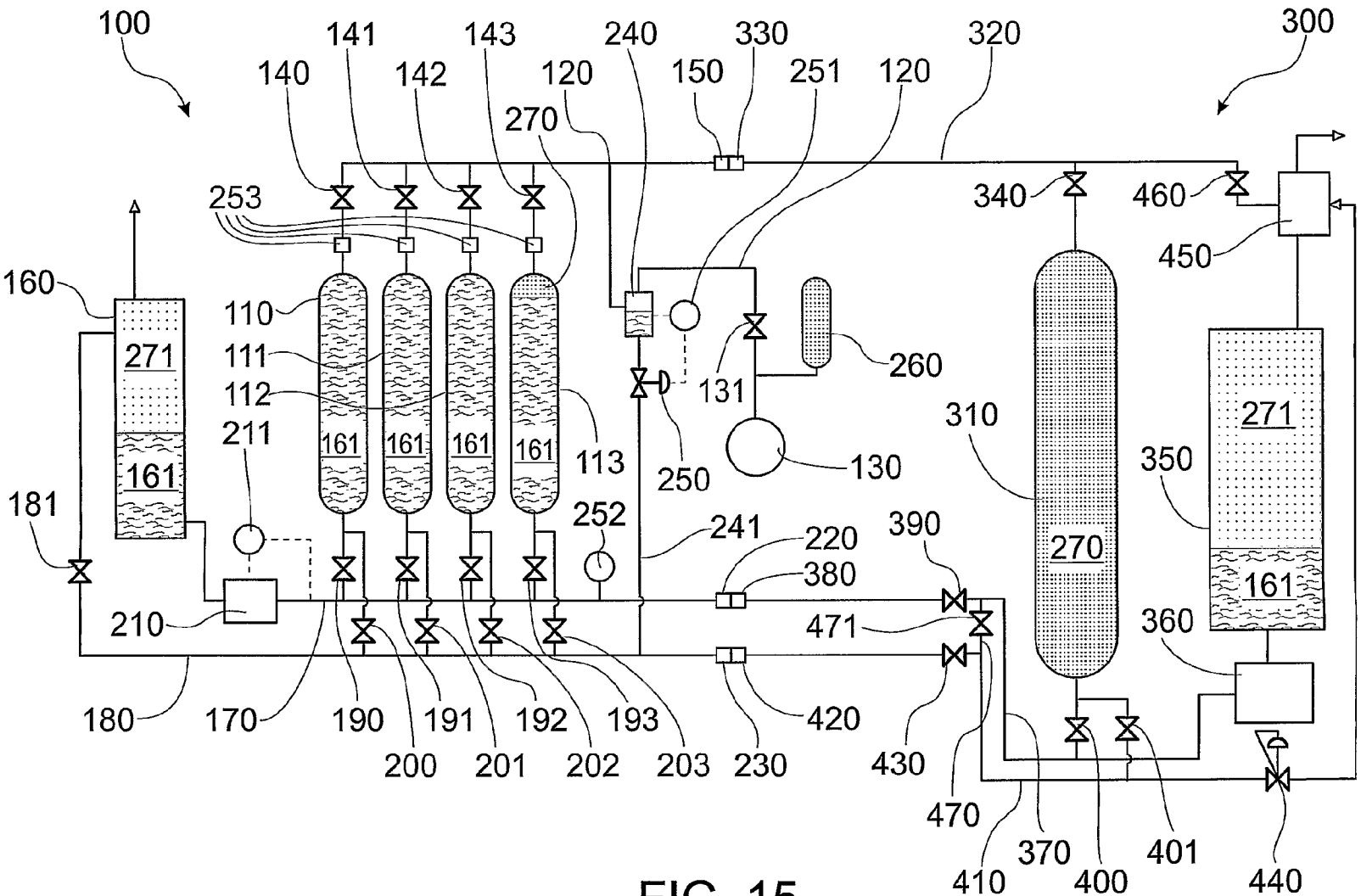
FIG. 15 is a schematic view of a compressed natural gas transfer system according to FIG. 4 in which the first three engine pressure vessels are filled with liquid.

When the first engine module pressure vessel 110, second engine module pressure vessel 111 and third engine module pressure vessel 112 are filled with liquid 161, the refuelling module pump 360 is switched off as shown in FIG. 15. The refuelling module liquid transfer valve 390 and refuelling module gas vent valve 460 are closed and the fourth refuelling module gas valve 143 on engine module pressure vessel 113 is opened. The first engine module liquid inlet valve 190, second engine module liquid inlet valve 191 and third engine module liquid inlet valve 192 are also closed. All of the engine module gas valves 140, 141, 142, 143 and the engine module liquid outlet valves 190, 191, 192, 193 of the gas transfer system 100 are opened.

Figure 16:
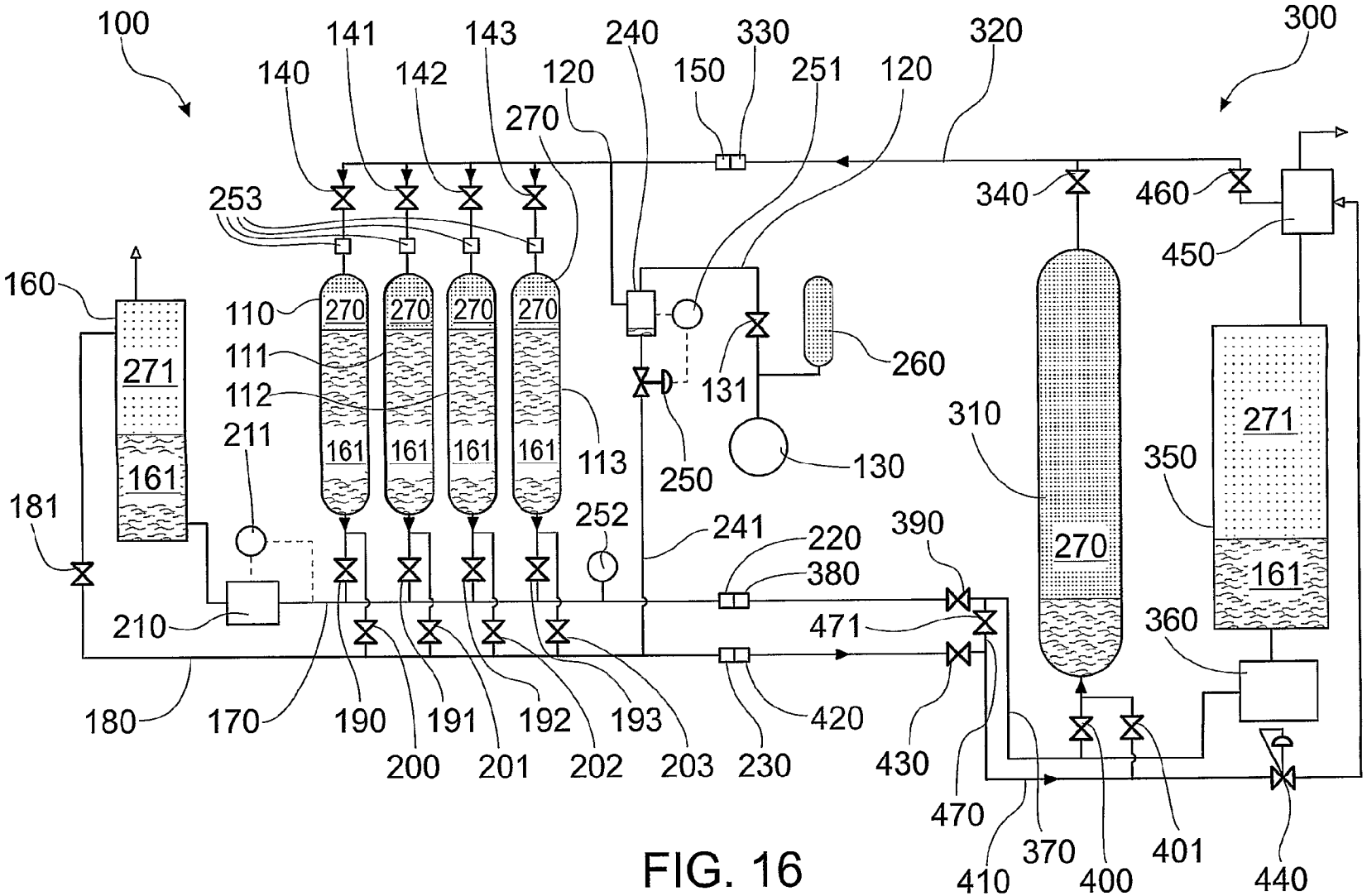
FIG. 16 is a schematic view of a compressed natural gas transfer system according to FIG. 4 in which high pressure gas is displacing the liquid from all four engine pressure vessels.

The refuelling module pump 360 is switched on and the refuelling module liquid inlet valve 400 for the refuelling module engine module pressure vessel 310 is opened. Liquid 161 at high pressure is then supplied from the refuelling module liquid reservoir 350, through the refuelling module liquid transfer line 370 into the refuelling module pressure vessel 310 as shown in FIG. 16. This causes gas 270 to be displaced through the refuelling module gas transfer line 320 of the refuelling module system 300 into the gas line 120 and into the engine module pressure vessels 110, 111, 112, 113 of the gas transfer system 100. This in turn causes the liquid 161 to be displaced from the engine module pressure vessels 110, 111, 112, 113 of the gas transfer system 100 and into the engine module liquid return line 180 of the gas transfer system 100. The liquid 161 passes from the engine module liquid return line 180 of the gas transfer system 100 into the refuelling module liquid return line 410 of the refuelling module system 300, through the refuelling module pressure control valve 440 and into the refuelling module gas separator 450 and from there into the refuelling module liquid reservoir 350.

Figure 17:
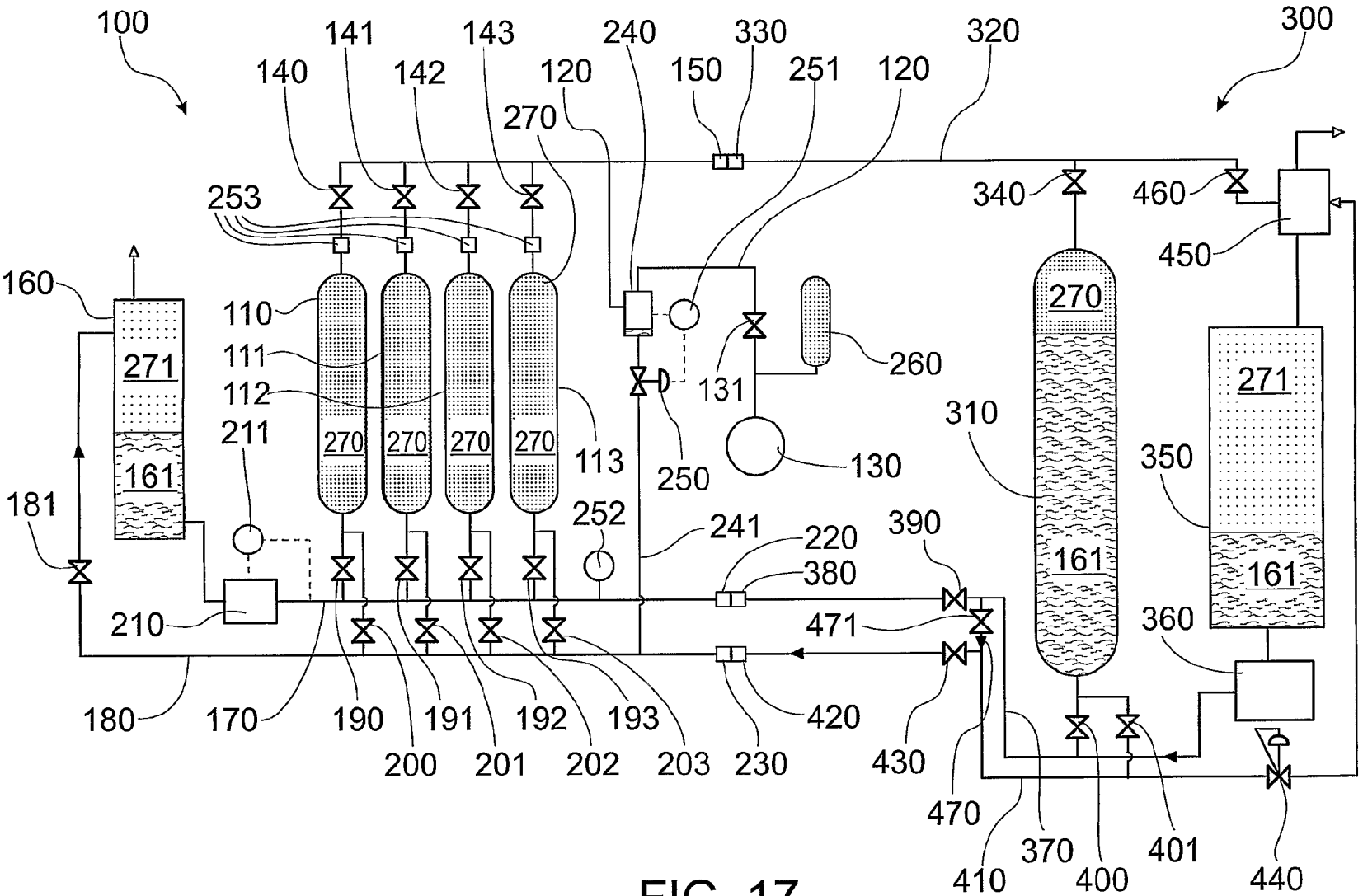
FIG. 17 is a schematic view of a compressed natural gas transfer system according to FIG. 4 in which the engine pressure vessels are filled with gas and a liquid reservoir is being refilled with liquid.

Once all the liquid 161 has been displaced from the engine module pressure vessels 110, 111, 112, 113 of the gas transfer system 100, the engine module gas valves 140, 141, 142, 143 and engine module liquid outlet valves 200, 201, 202, 203 are closed. The refuelling module liquid inlet valve 400 of the refuelling module engine module pressure vessel 310 is also closed. This completes refuelling module of the engine module pressure vessels 110, 111, 112, 113 in the gas transfer system 100 as is shown in FIG. 17. Once refuelling module of engine module pressure vessels 110, 111, 112, 113 with gas 270 is completed, the refuelling module pump 360 is switched on and the refuelling module intermediate valve 470 linking the refuelling module liquid transfer line 370 and the refuelling module liquid refuelling module return line 410 is opened. Liquid 161 is supplied from the refuelling module liquid reservoir 350 through the refuelling module liquid transfer line 370, through the refuelling module intermediate valve 470, through the refuelling module liquid return line 410, through the engine module return line 180 and into the engine module liquid reservoir 160 of the gas transfer system 100.

Figure 18:
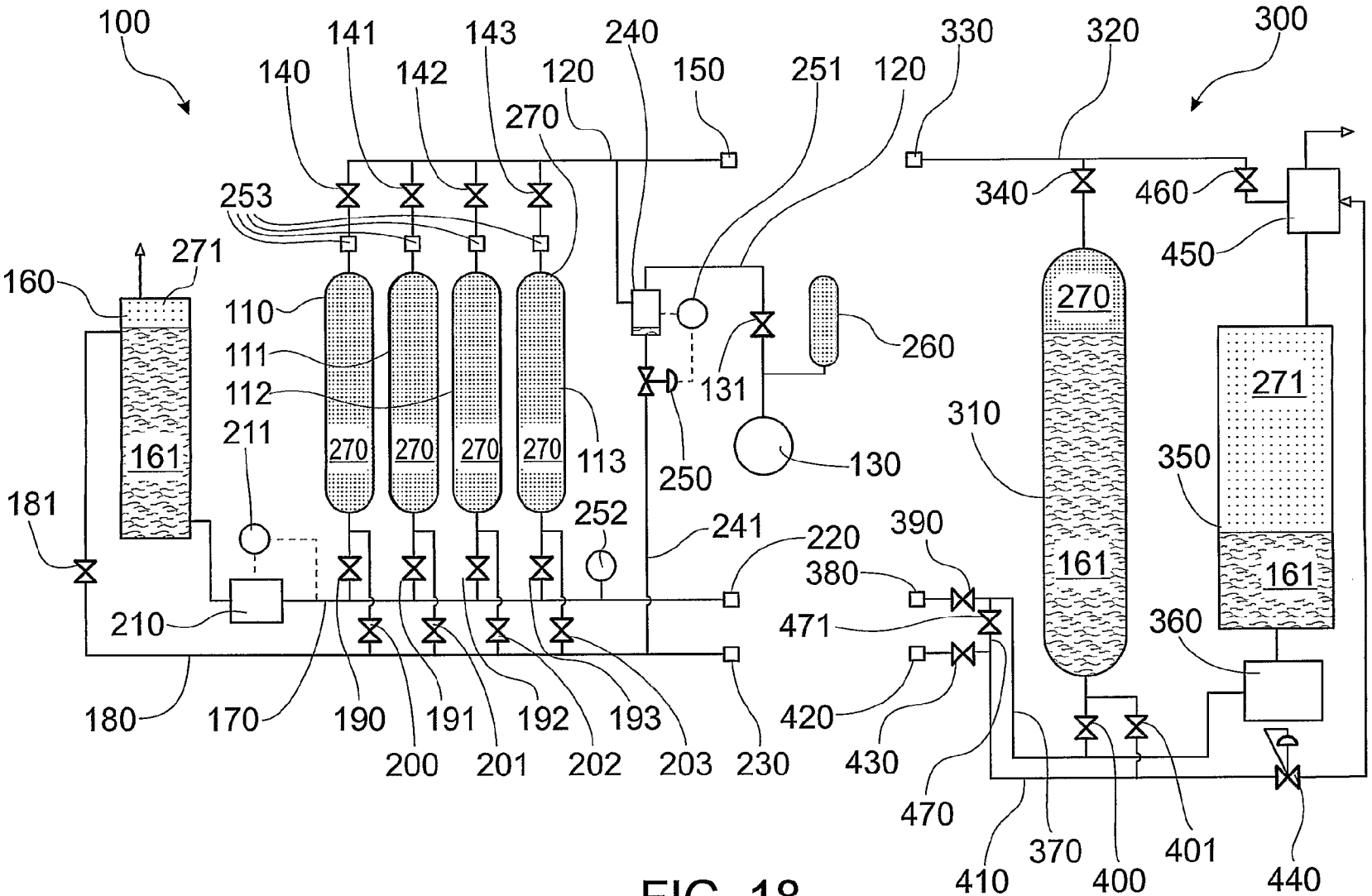
FIG. 18 is a schematic view of a compressed natural gas transfer system according to FIG. 4 just after disconnection from the refuelling system.

Once the engine module liquid reservoir 160 is filled with a predetermined amount of liquid 161, all valves are closed and the gas transfer system 100 is disconnected from the refuelling module system 300 and the engine 130 is again ready to operate as shown in FIG. 18.

Figure 19:
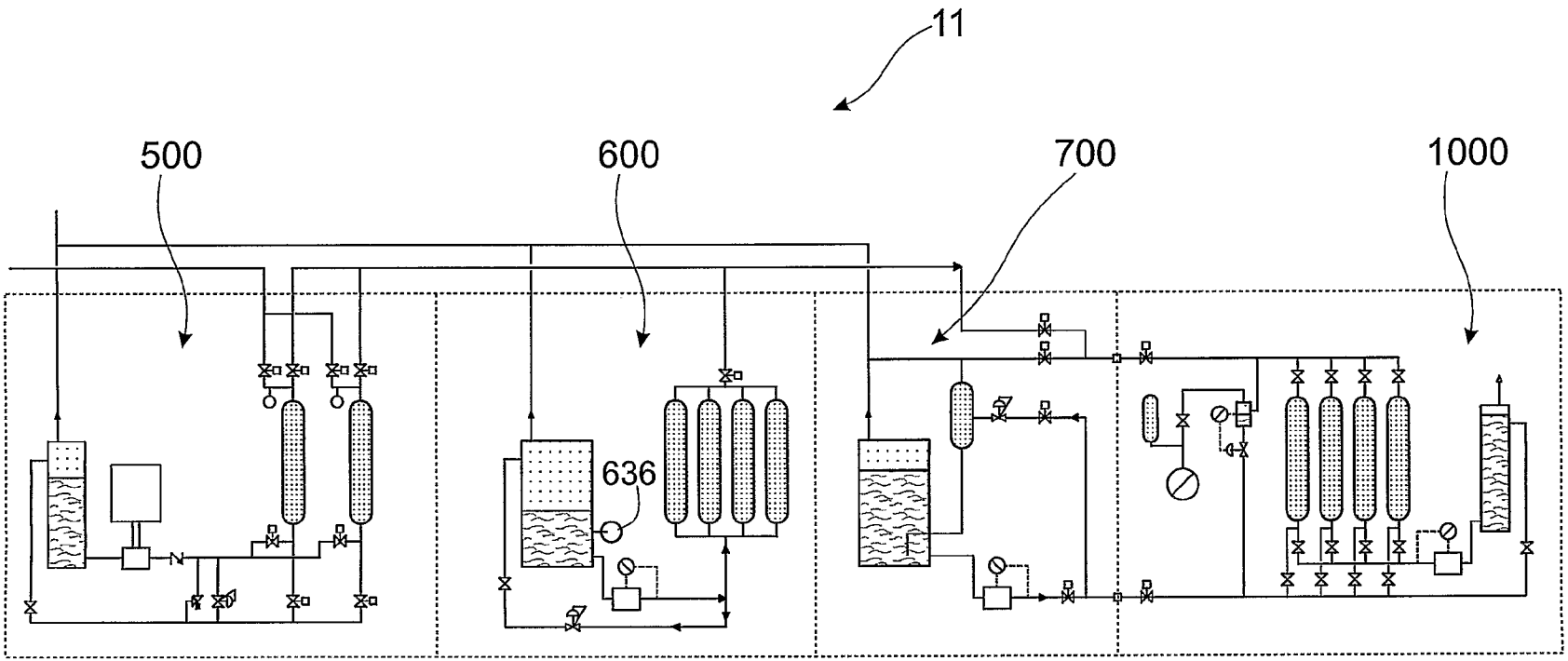
FIG. 19 is a schematic view of a compressed natural gas transfer system according to a third embodiment of the invention.

FIG. 19 shows a third embodiment of a transfer system 11 that includes a gas compression module 500, a CNG storage module 600, a vehicle refuelling module 700 and an engine module 1000.

Figure 20:
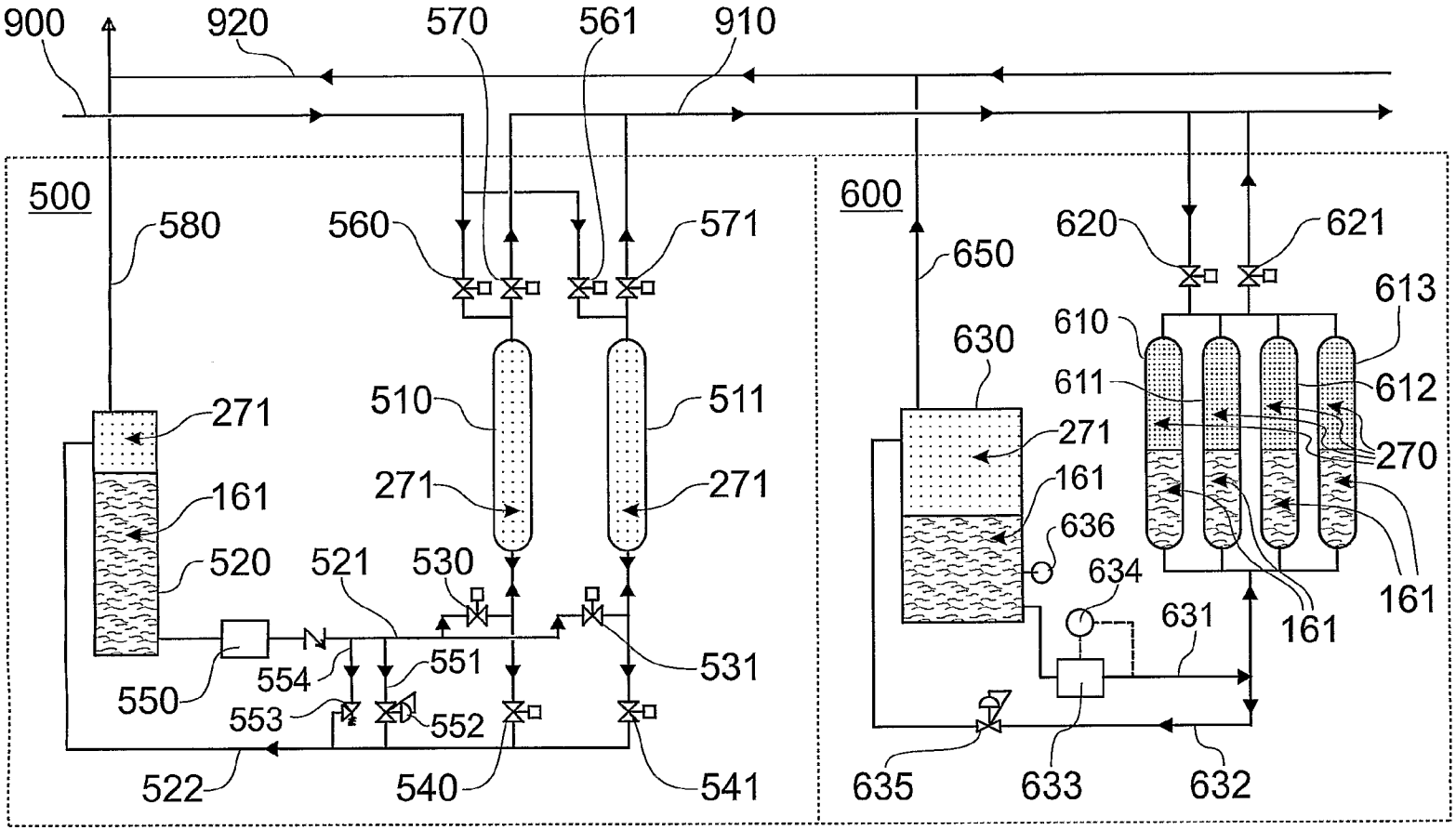
FIG. 20 is a schematic view of a compressed natural gas transfer system according to FIG. 19 showing greater details of a compression module connected to a storage module.

FIG. 20 shows a schematic representation of the gas compression module 500 and CNG storage module 600 in greater detail.

The compression module 500 is used to convert low pressure natural gas to high pressure natural gas, i.e. the pressure of a natural gas is taken from approximately supply pressure 300 psi to the desired CNG pressure (typically 3600 psi to 5000 psi).

The compression module 500 includes two compression module pressure vessels 510, 511 in the form of tanks. The volume of each of the compression module pressure vessels 510, 511 is dependent upon the application.

A compression module liquid reservoir 520 is connected to the compression module pressure vessels 510, 511 via a compression module liquid delivery line 521 and a compression module liquid return line 522. The compression module liquid reservoir 520 is filled with liquid 161. The liquid 161 is typically water with salt being added to the water in low temperature environments. Compression module liquid inlet valves 530, 531 are used to permit the delivery of liquid 161 from the compression module liquid reservoir 520 to the compression module pressure vessels 510, 511 via the compression module liquid delivery line 521. Compression module liquid outlet valves 540, 541 are used to allow liquid 161 to return from the compression module pressure vessels 510, 511 through the compression module liquid return line 522.

A compression module pump 550 is located within the compression module liquid delivery line 521 to pump the liquid 161 from the compression module liquid reservoir 520 to the compression module pressure vessels 510, 511. A compression module back pressure line 551 and associated compression module back pressure valve 552 links the compression module liquid delivery line 521 to the compression module liquid return line 522. Accordingly, if sufficient pressure occurs within the compression module liquid delivery line 521, liquid 161 will flow through the compression module back pressure line 551 into the compression module liquid return line 522. A compression module pressure safety valve 553 and compression module pressure safety valve line 554 links the compression module liquid delivery line 521 to the compression module liquid return line 522.

A low pressure natural gas line 900 is connected to both of the compression module pressure vessels 510, 511. Compression module gas inlet valves 560, 561 are used to control the flow of low pressure natural gas travelling through the low pressure natural gas line 900. A high pressure natural gas line 910 is connected to both of the compression module pressure vessels 510, 511. Compression module gas outlet valves 570, 571 control the flow of gas from the compression module pressure vessels 510, 511.

A compression module vapour recovery line 580 connects the compression module liquid reservoir 520 to a vapour recovery system (not shown). Vapour recovery systems are well known in the art and accordingly, no further detail is provided.

The storage module 600 is used to store high pressure natural gas and also to supply the vehicle refuelling module with high pressure natural gas.

The storage module 600 is connected to the compression module 500 via the high pressure natural gas line 910 which is connected to storage module pressure vessels 610, 611, 612, 613. A storage module gas inlet valve 620 and storage module gas outlet valve 621 dictate whether gas is able to pass into and/or out of the storage module pressure vessels 610, 611, 612, 613. It should be appreciated that the number and size of the storage module pressure vessels 610, 611, 612, 613 may be varied depending on design requirements.

A storage module liquid reservoir 630 is connected to the storage module pressure vessels 610, 611, 612, 613 via a storage module liquid delivery line 631 and a storage module liquid return line 632. The storage module liquid reservoir 630 is filled with liquid 161. The liquid is typically water with salt being added to the water in low temperature environments. A storage module liquid reservoir level sensor 636 is located on the storage module liquid reservoir 630 to determine the level of liquid 161 in the storage module liquid reservoir 630 and hence the amount of liquid 161 in storage module pressure vessels 610, 611, 612, 613. That is, change in liquid level in the storage module liquid reservoir 630 is proportionate with liquid level in the storage module pressure vessels 610, 611, 612, 613.

A storage module pump 633 is located within the storage module liquid delivery line 631 to pump the liquid 161 from the storage module liquid reservoir 630 to the storage module pressure vessels 610, 611, 612, 613. A storage module pump pressure controller 634 is connected to the storage module pump 633 and the storage module liquid delivery line 631 to ensure the flow rate of liquid supplied to the storage module pressure vessels 610, 611, 612, 613 is controlled to maintain a relatively constant pressure of gas located in the storage module pressure vessels 610, 611, 612, 613 from which gas is being transferred.

A storage module back pressure valve 635 is located within the storage module liquid return line 632 to allow liquid 161 to return to the storage module liquid reservoir 630 when the pressure located within the storage module liquid return line 632 reaches a predetermined pressure.

A storage module vapour recovery line 650 connects the storage module liquid reservoir 630 to a main vapour recovery line 920 which leads to a vapour recovery unit (not shown).

In use, the compression module pressure vessels 510, 511 are both fully charged with natural gas 271 at a low pressure provided by the natural gas line 900. All the valves in the compression module 500 are in a closed position. The storage module pressure vessels 610, 611, 612, 613 are all half filled with high pressure gas 270. The storage module gas transfer valve 620 is open and both the storage module pump 633 and storage module back pressure valve 635 are non-operational.

Figure 21:
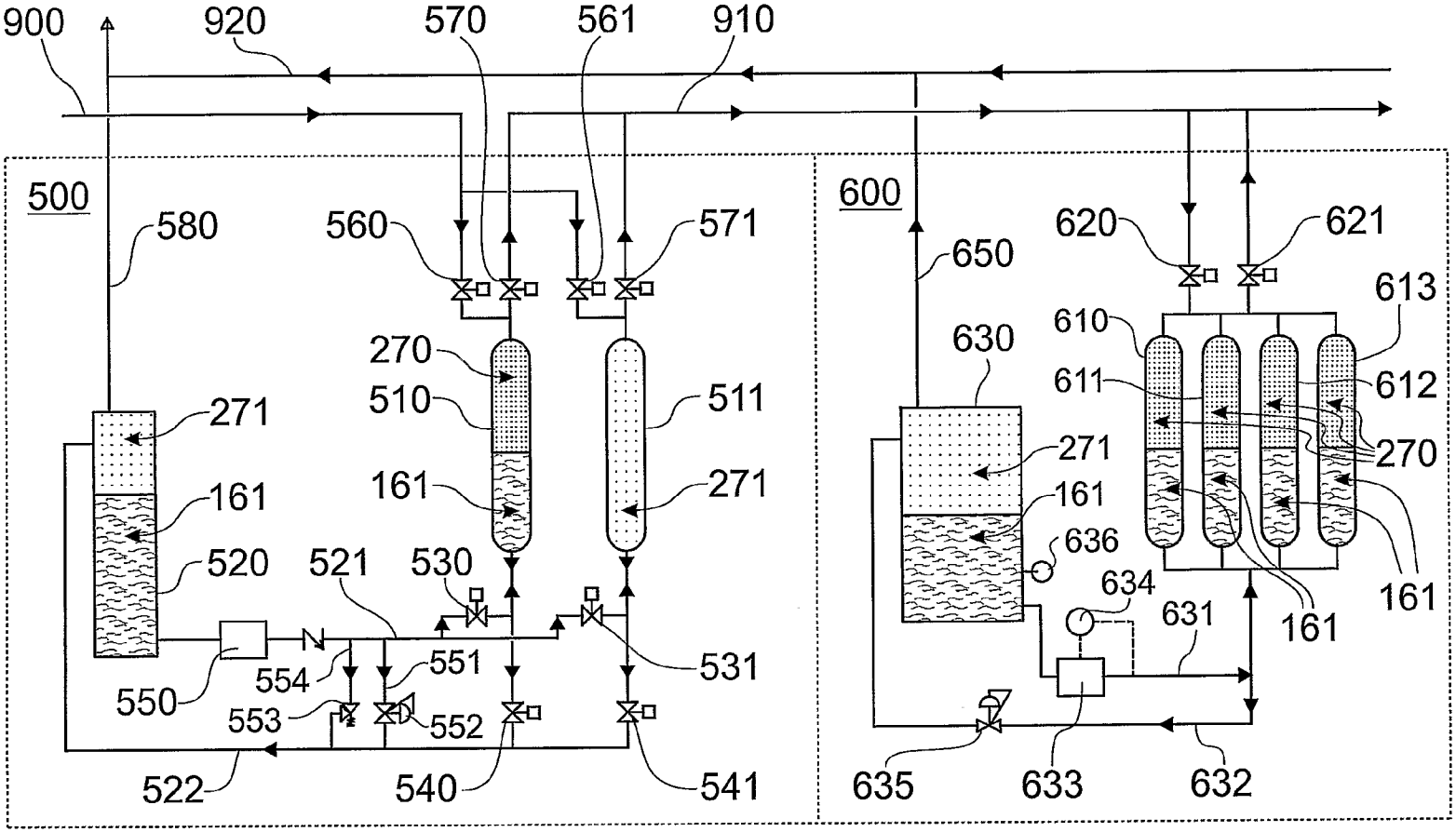
FIG. 21 is a schematic view of a compressed natural gas transfer system according to FIG. 19 with liquid being pumped into the first compression module pressure vessel.
Figure 22:
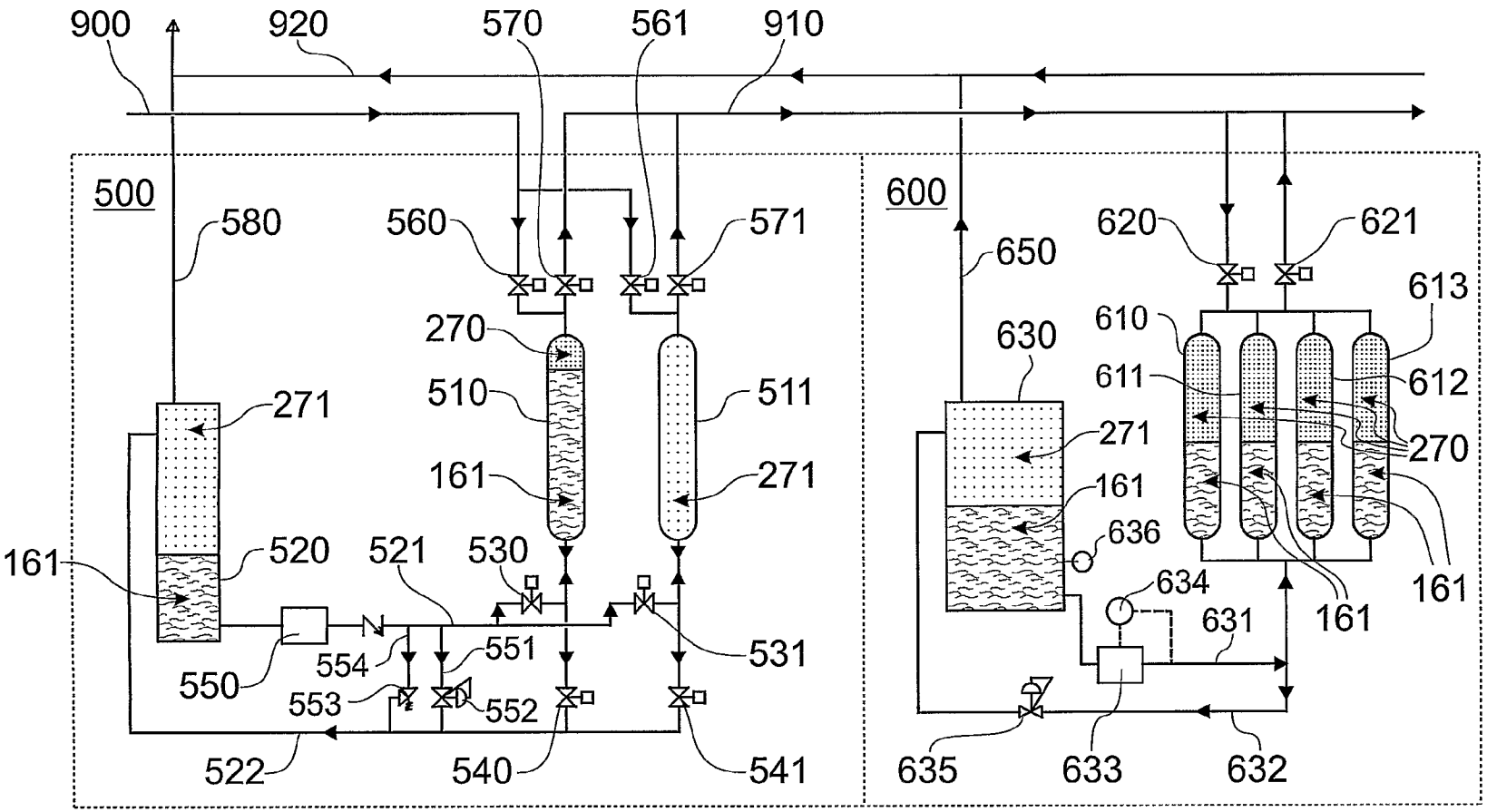
FIG. 22 is a schematic view of a compressed natural gas transfer system according to FIG. 19 in which gas is fully compressed with the first compression module pressure vessel.

In order to commence the compression of low pressure natural gas 271, the compression module pump 550 is operated and the first compression module liquid inlet valve 530 is moved to an open position. Liquid 161 is pumped from the compression module liquid reservoir 520 through the compression module liquid delivery line 521 into the first compression module pressure vessel 510 as shown in FIG. 21. Liquid 161 is continued to be pumped into the first compression gas module pressure vessel 510 until a desired gas pressure is obtained as is shown in FIG. 22.

Figure 23:
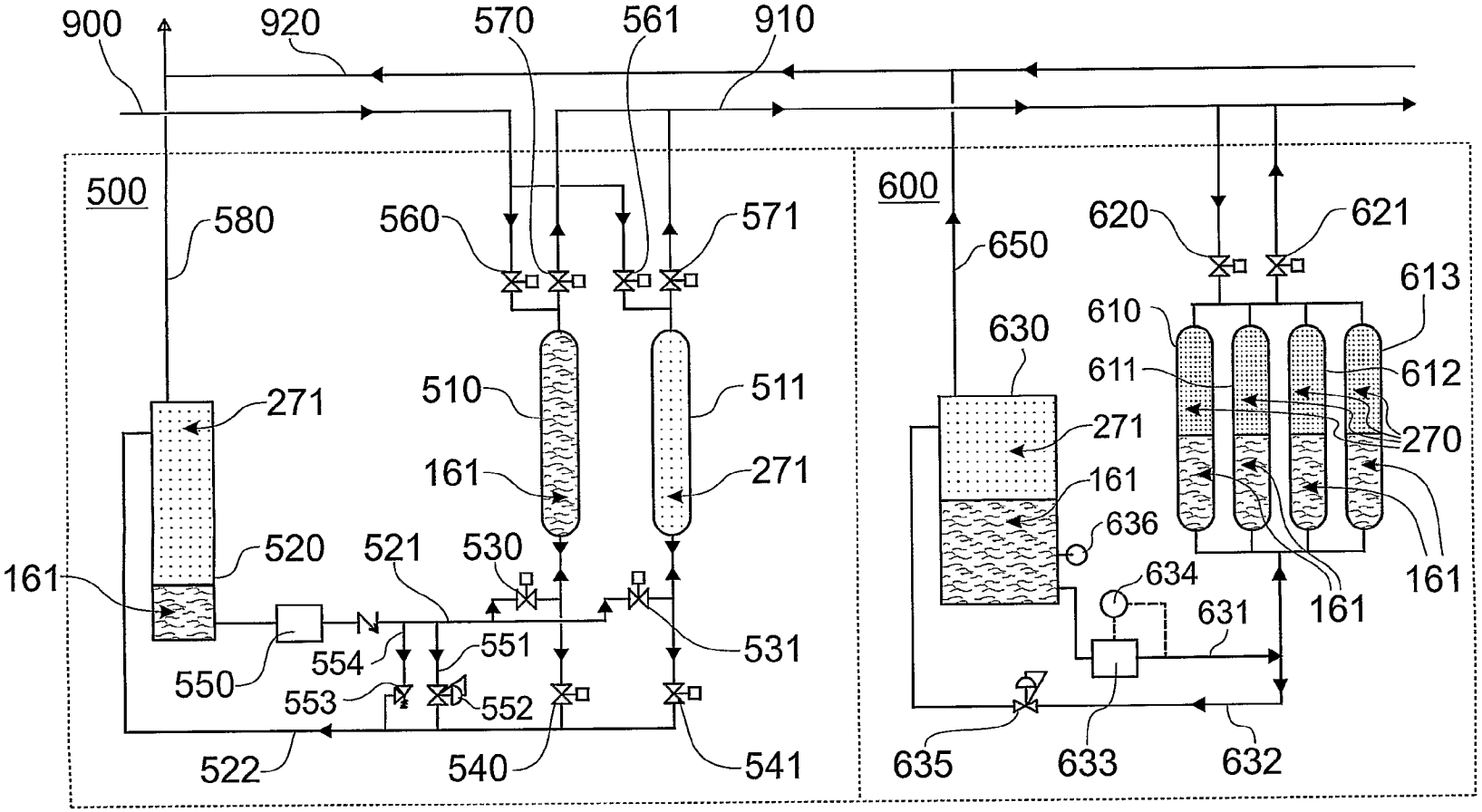
FIG. 23 is a schematic view of a compressed natural gas transfer system according to FIG. 19 in which gas flows from the first compression module pressure vessel into the storage module pressure vessel.

When the desired high gas pressure is obtained within the first compression module pressure vessel 510, the first compression module gas outlet valve 570 is moved to an open position. Liquid 161 is continued to be pumped from the compression module liquid reservoir 520 into the first compression pressure vessel 510 to force high pressure gas 270 into the high pressure natural gas line 910. This causes gas to flow from the high pressure natural gas line 910 through the storage module gas inlet valve 620 and into the storage module pressure vessels 610, 611, 612, 613. Liquid 161 flows from the storage module pressure vessels 610, 611, 612, 613 through the storage module liquid return line 632 through the storage module back pressure valve 635 and into the storage module liquid reservoir 630. This process is continued until the first compression module pressure vessel 510 is filled with liquid 161 and thus emptied of high pressure gas 270 as is shown in FIG. 23.

At this stage, the first compression module liquid inlet valve 530 and the first compression module gas outlet valve 570 are moved to a closed position. The first compression module gas outlet valve 560 is moved to an open position as is the first compression module liquid outlet valve 540. Simultaneously, the second compression module liquid inlet valve 531 and the second compression module gas inlet valve 561 is moved to an open position. The storage module is awaiting further filling.

Figure 24:
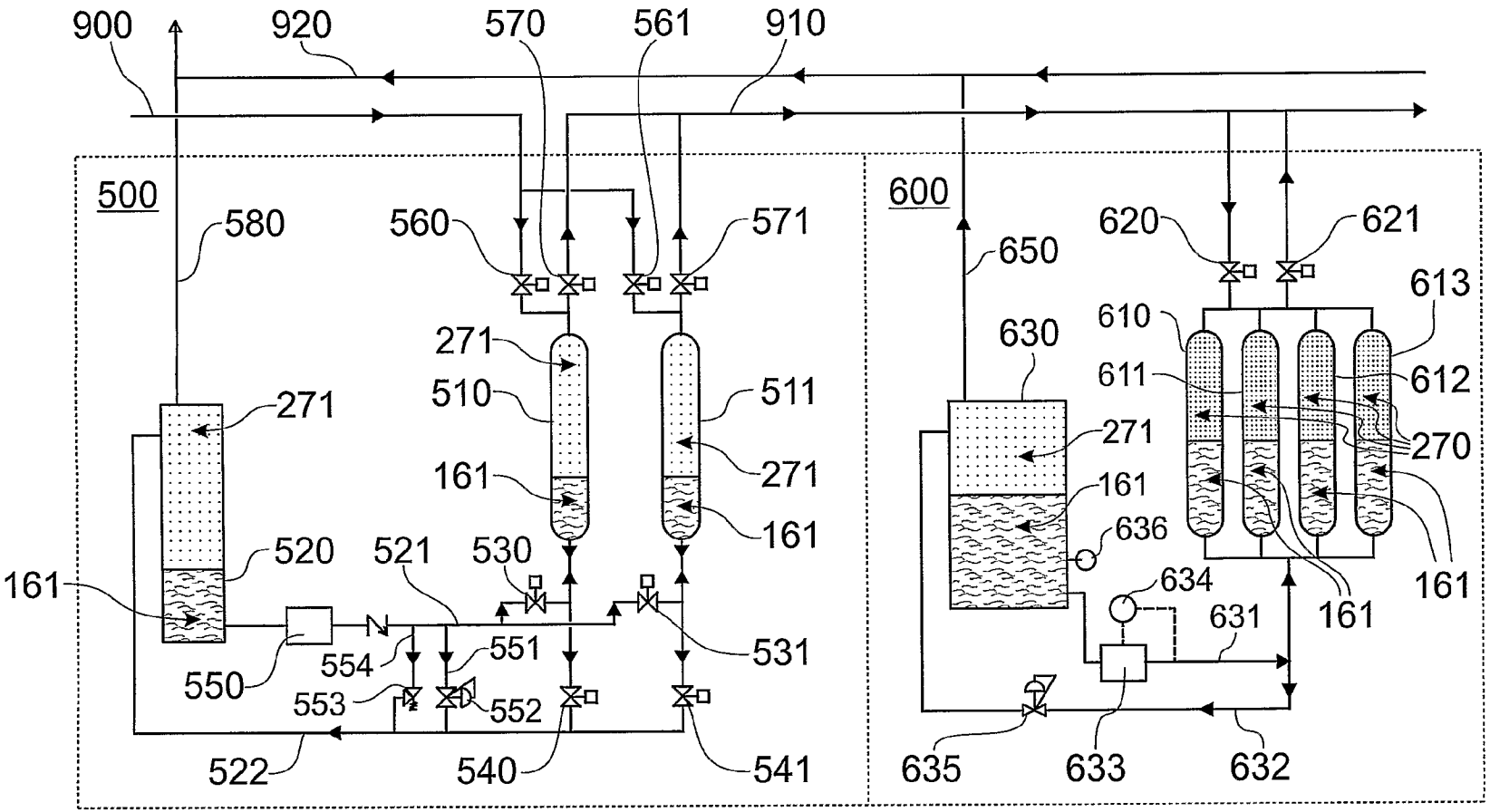
FIG. 24 is a schematic view of a compressed natural gas transfer system according to FIG. 19 in which low pressure gas is fed into the first compression module pressure vessel and liquid is being pumped into the second compression module pressure vessel.
Figure 25:
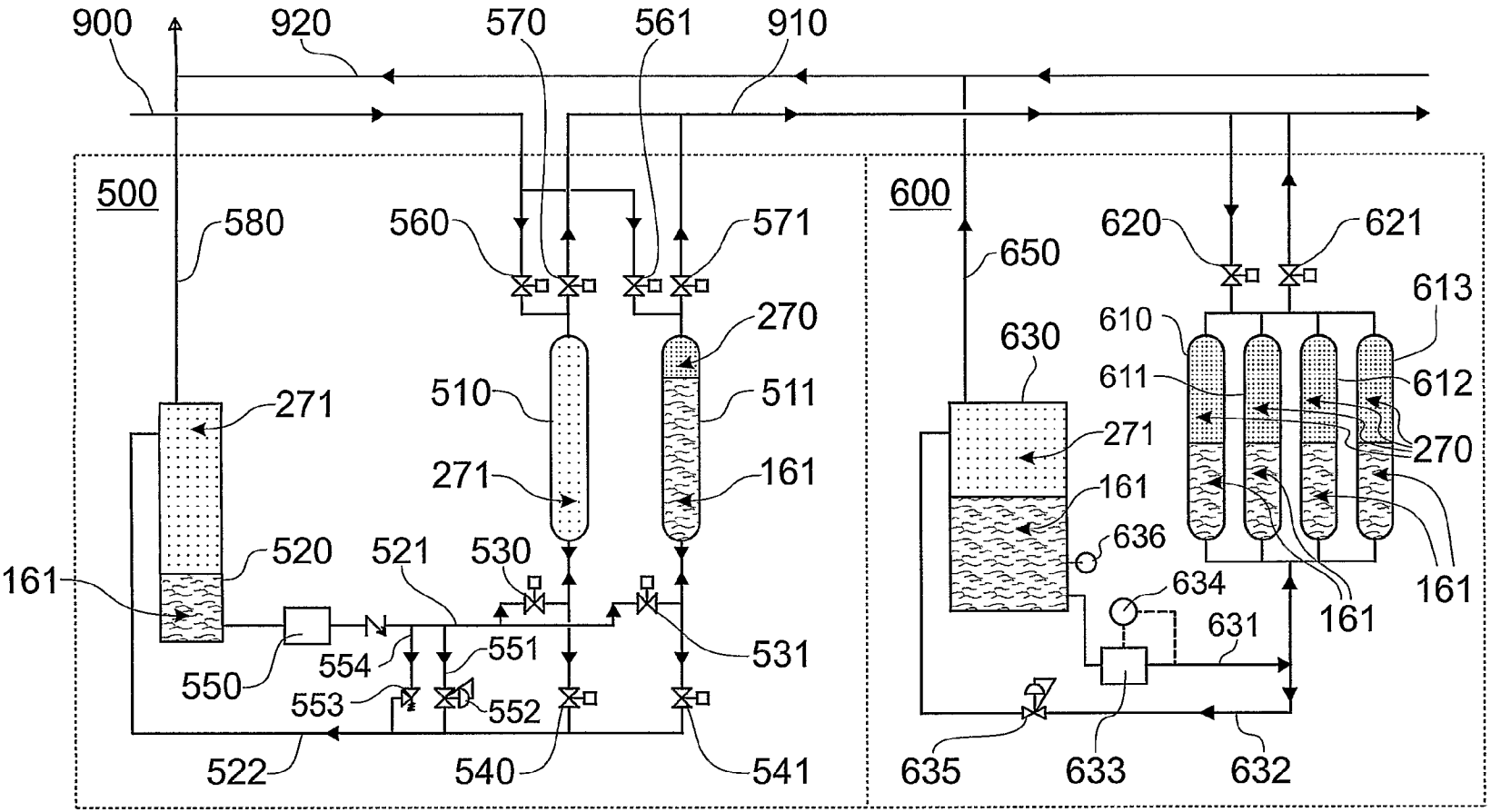
FIG. 25 is a schematic view of a compressed natural gas transfer system according to FIG. 19 in which low pressure gas has filled the first compression module pressure vessel and gas is fully compressed in the second compression module pressure vessel.
Figure 26:
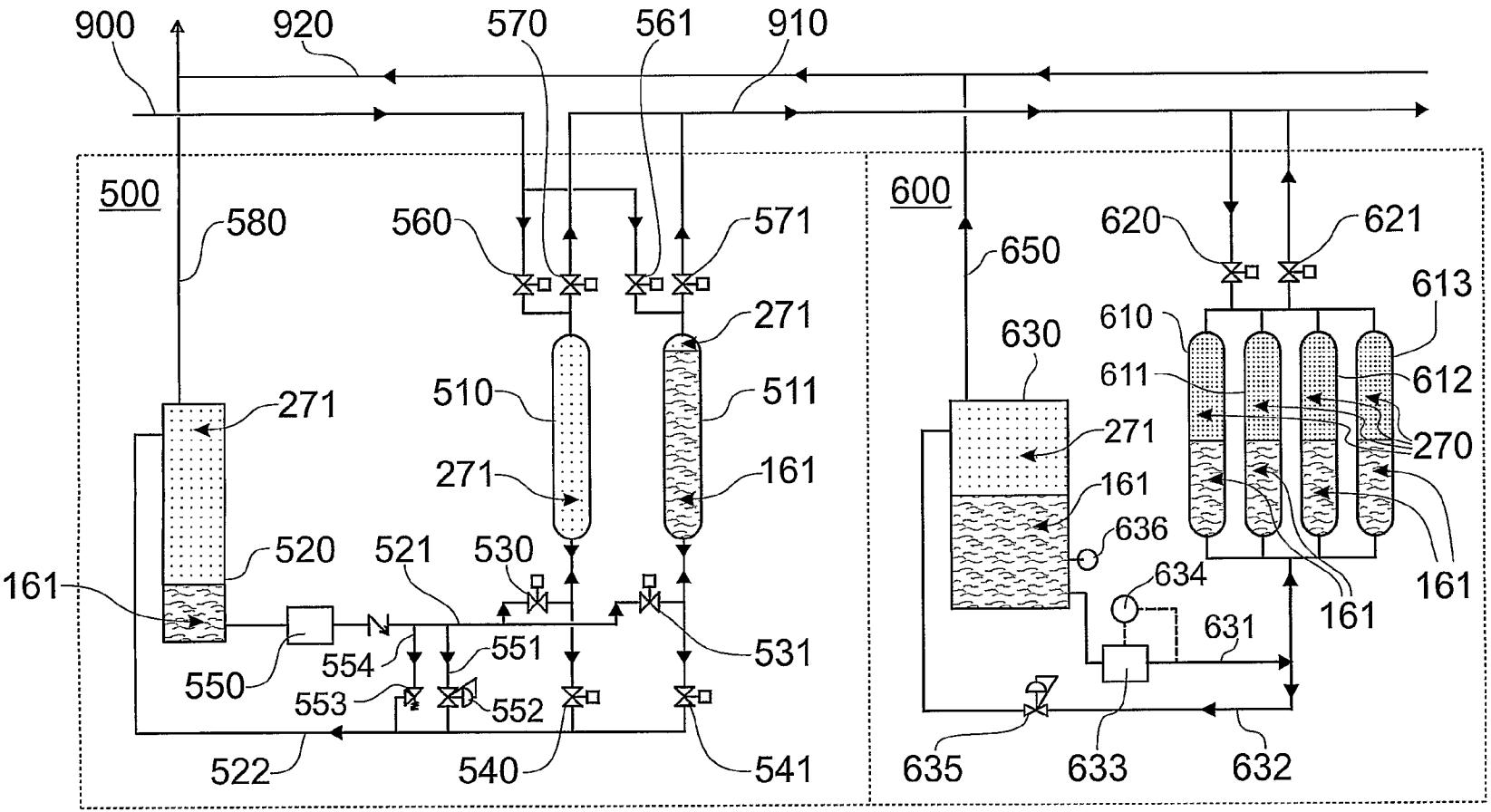
FIG. 26 is a schematic view of a compressed natural gas transfer system according to FIG. 19 in which gas flows from the second compression module pressure vessel into the storage module pressure vessel.

FIG. 24 shows liquid 161 being pumped from the compression module liquid reservoir 520 by the compression module pump 550 through the compression module liquid delivery line 521 and into the second compression module pressure vessel 511. Simultaneously, low pressure natural gas is being fed from the low pressure natural gas line 900 into the first compression module pressure vessel 510 forcing liquid 161 from the first compression module pressure vessel 510 through the compression module liquid return line 522 and into the compression module liquid reservoir 520. Low pressure natural gas 271 is fed into the first compression module pressure vessel 510 until the first compression module pressure vessel 510 is filled with low pressure gas 271 and emptied of liquid 161. At this point, the first compression module gas inlet valve 560 is switched to a closed position as is the first compression module liquid outlet valve 540 as is shown in FIG. 25. Liquid 161 continues to flow from the compression module liquid reservoir 520 into the second compression module pressure vessel 511 until the gas located within the second compression module pressure vessel 511 is at a desired high pressure as is shown in FIG. 26.

Once the gas located within the second compression module pressure vessel 511 is at a desired high pressure, the second compression module gas outlet valve 571 is moved to an open position to allow gas to flow into the high pressure natural gas line 910 through the storage module gas inlet valve 620 and into the storage module pressure vessels 610, 611, 612, 613. Again, liquid 161 passes from the storage module pressure vessels 610, 611, 612, 613 through the storage module liquid return line 632 opening the storage module back pressure valve 635 with liquid 161 flowing into the storage module liquid reservoir 630.

Figure 27:
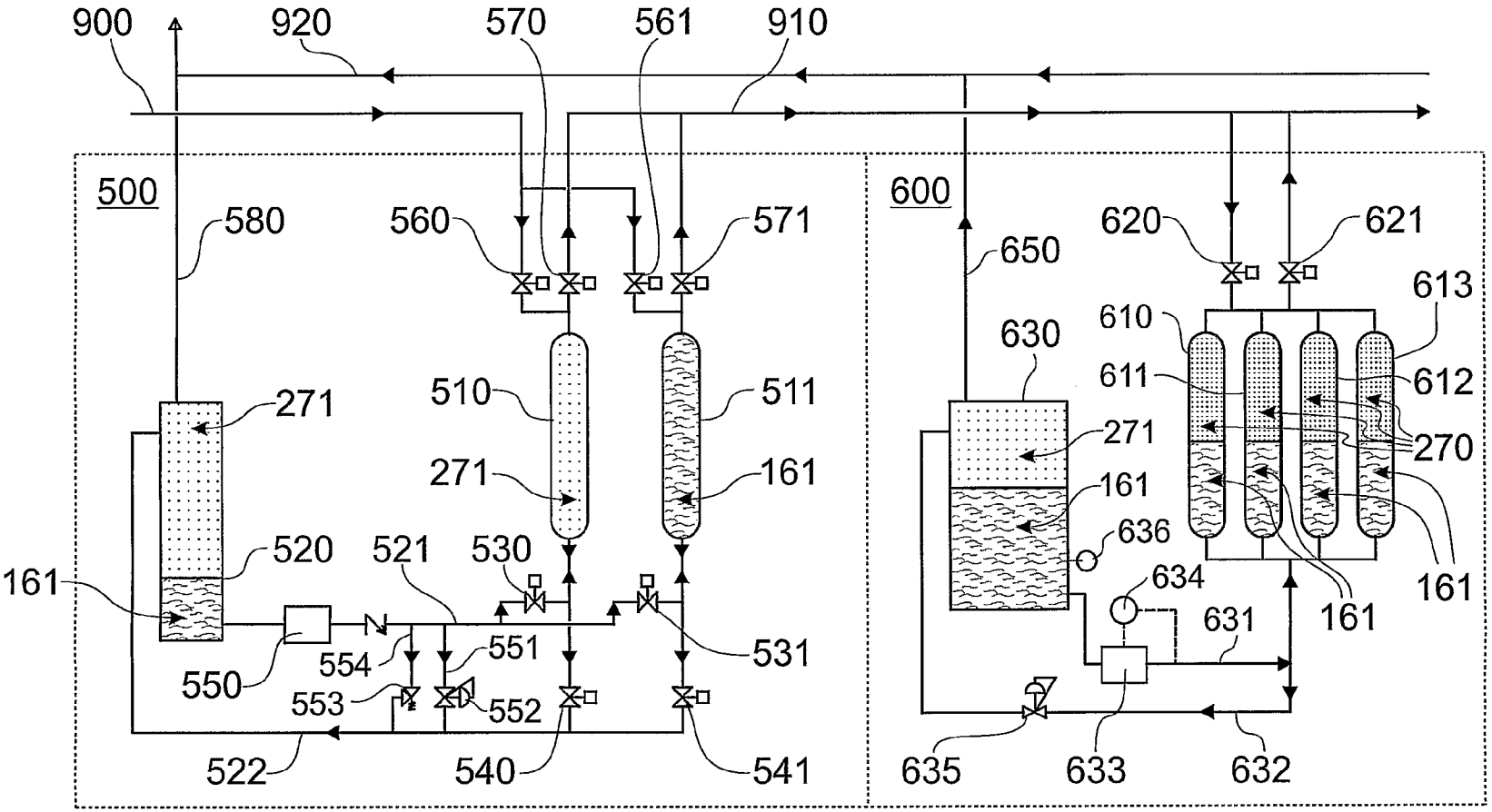
FIG. 27 is a schematic view of a compressed natural gas transfer system according to FIG. 19 in which liquid has displaced all of the gas from the second compression module pressure vessel.

Once the second compression module pressure vessel 511 is filled with liquid, i.e. all of the high pressure gas 270 has passed from the second compression module pressure vessel 511 into the high pressure natural gas line 910, the second compression module gas outlet valve 571 and second compression module liquid inlet valve 531 are closed. Both the second compression module gas inlet valve 561 and second compression module liquid outlet valve 541 are then simultaneously moved to an open position as shown in FIG. 27. The first compression module liquid inlet valve 530 is also moved to an open position.

Figure 28:
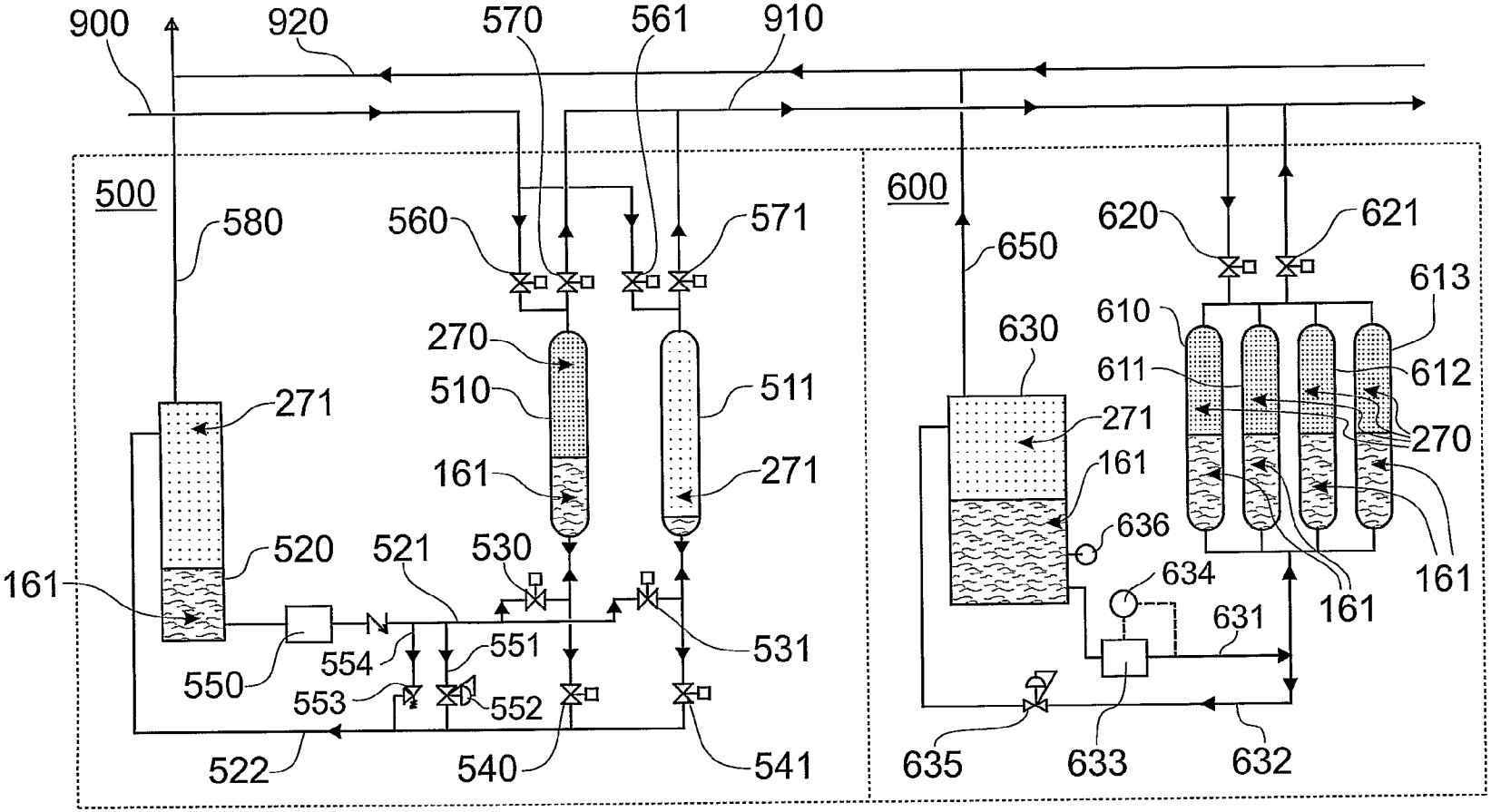
FIG. 28 is a schematic view of a compressed natural gas transfer system according to FIG. 19 in which low pressure gas is fed into the second compression module pressure vessel and liquid is being pumped into the first compression module pressure vessel.

Liquid 161 is pumped from the compression module liquid reservoir 520 through the compression module liquid delivery line 521 and into the first compression module pressure vessel 510 to compress the gas located within the first compression module pressure vessel 510. Simultaneously, gas flows from the low pressure natural gas line 900 into the second compression module pressure vessel 511 forcing liquid 161 from the second compression module pressure vessel 511 through the compression module liquid return line 522 and into the compression module liquid reservoir 520 as shown in FIG. 28. Once the second compression module pressure vessel 511 is emptied of liquid 161 and filled with low pressure gas 270, the second compression module gas inlet valve 561 and second compression module liquid outlet valve 541 are switched to a closed position. Liquid 161 is continued to be pumped into the first compression module pressure vessel 510 until gas located within the first compression module pressure vessel 510 reaches a desired high pressure as shown in FIG. 29.

Figure 29:
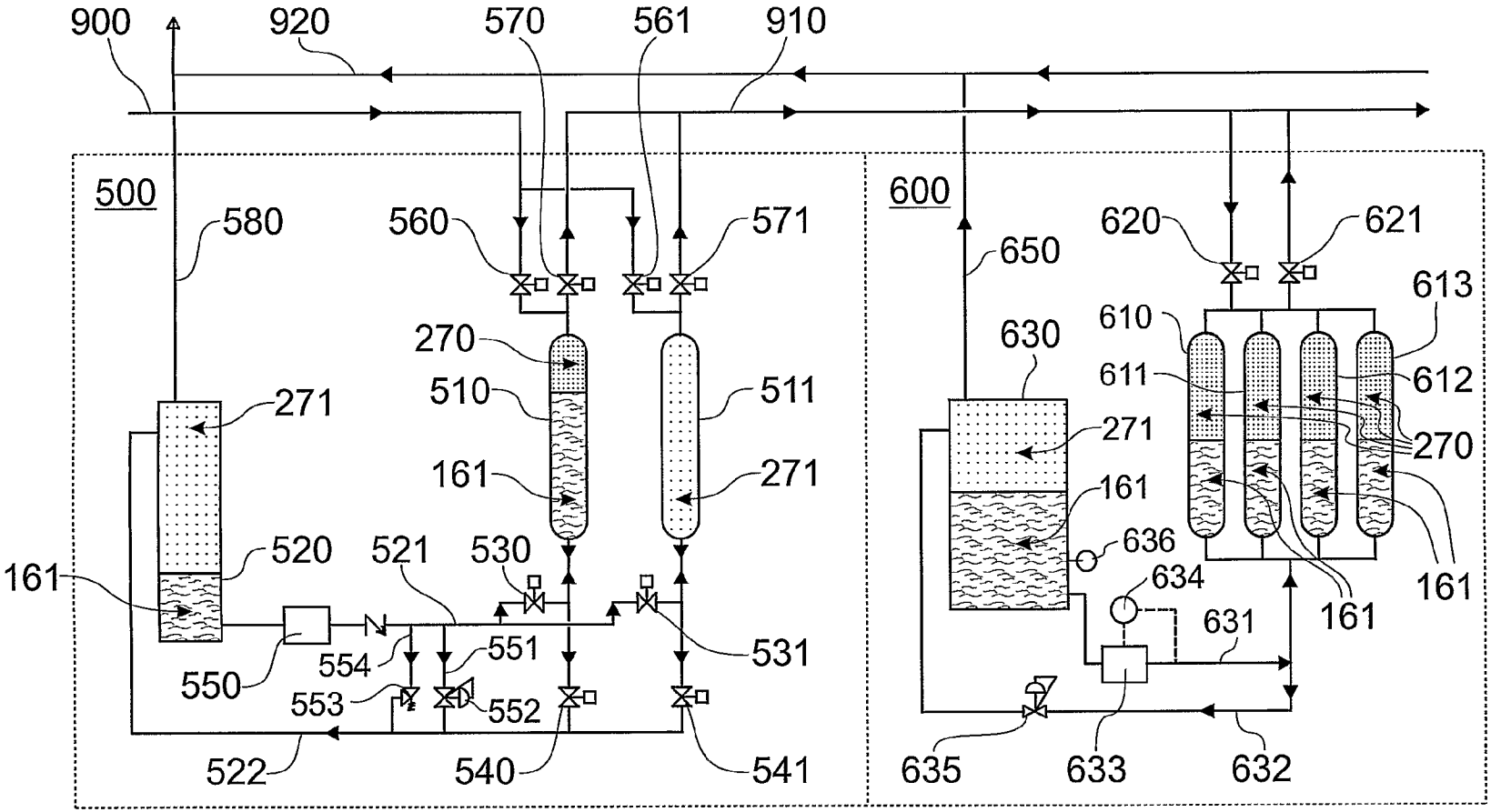
FIG. 29 is a schematic view of a compressed natural gas transfer system according to FIG. 19 in which low pressure gas has filled the second compression module pressure vessel and gas is being compressed with the first compression module pressure vessel.
Figure 30:
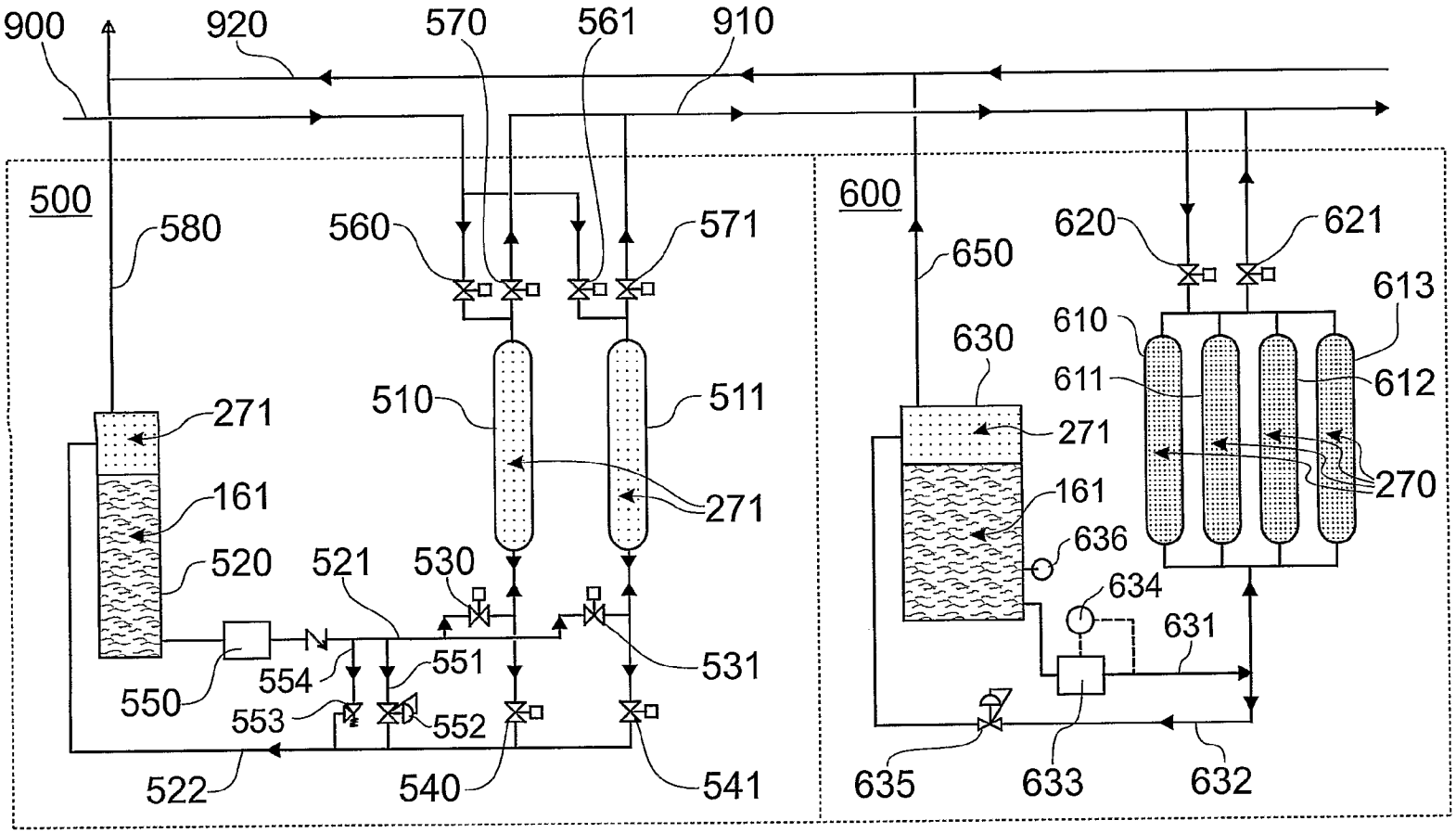
FIG. 30 is a schematic view of a compressed natural gas transfer system according to FIG. 19 in which the storage module pressure vessels are full with high pressure gas and the compression module pressure vessels are filled with low pressure gas.

The entire process from FIG. 21 through to FIG. 29 is then repeated until all of the storage module pressure vessels 610, 611, 612, 613 are filled with high pressure gas. At this point in time, gas from the low pressure natural gas line 900 is fed through both of the compression module gas inlets 560, 561 to allow all the liquid 161 located within the compression module pressure vessels 510, 511 to pass into the compression module liquid reservoir 520 as shown in FIG. 30. The first compression module gas inlet valves 560, 561 are moved to a closed position as is the compression module liquid delivery valves 530, 531 so that the entire process from FIG. 20 can be recommenced once the storage module pressure vessels 610, 611, 612, 613 are less than full.

Figure 31:
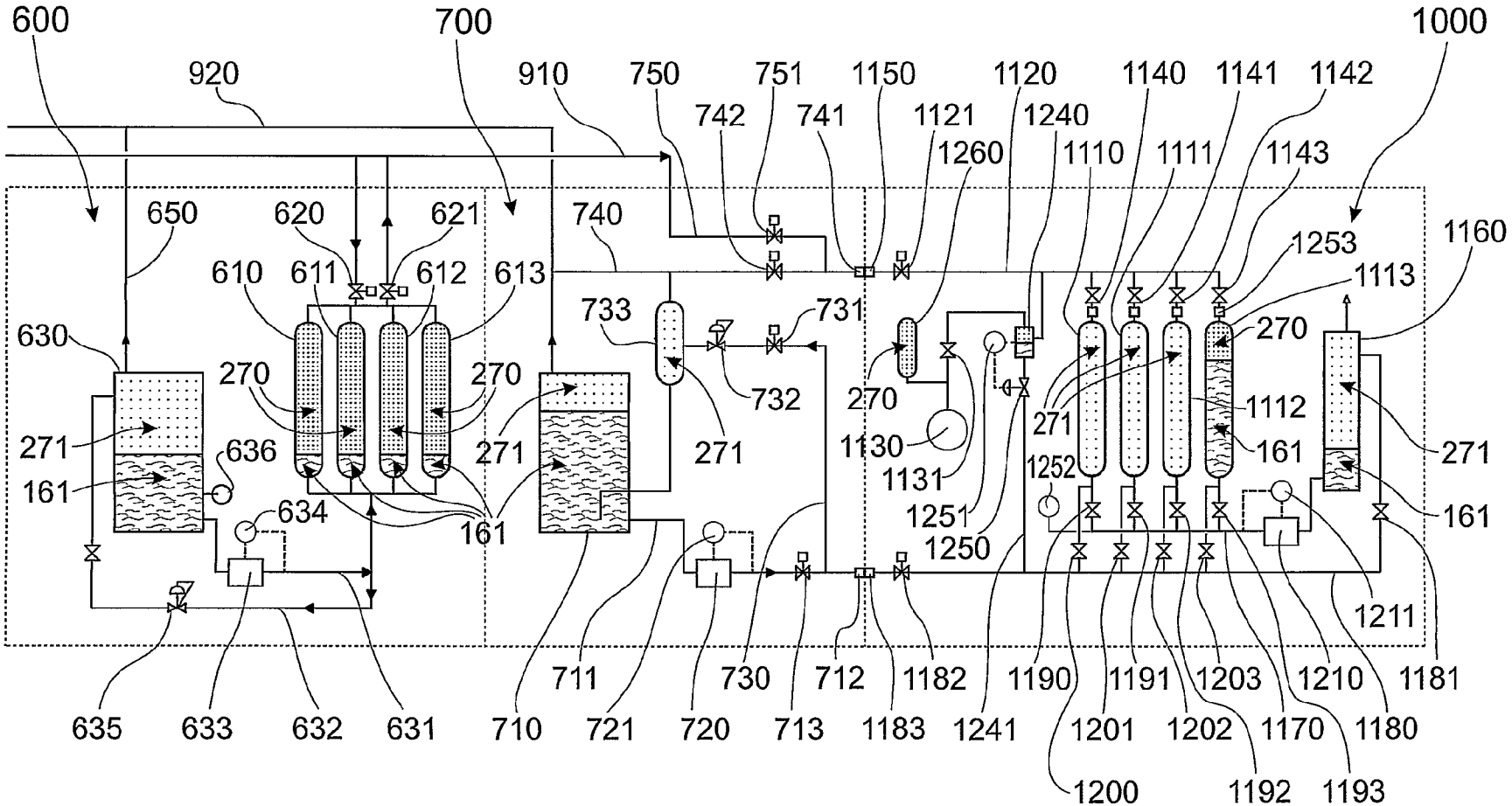
FIG. 31 is a schematic view of a compressed natural gas transfer system according to FIG. 19 showing greater details of a storage module, vehicle refuelling module and a vehicle module.

FIG. 31 shows the gas storage module 600, vehicle refuelling module 700 and engine module 1000 in greater detail.

The vehicle refuelling module 700 includes a refuelling module reservoir 710 that is filled with liquid 161. The liquid 161 is typically water with salt being added to the water in low temperature environments. A refuelling module liquid delivery line 711 extends from the refuelling module liquid reservoir 710 to a refuelling module liquid refuelling coupling 712. A refuelling module pump 720 is located within the refuelling module liquid delivery line 711 to pump liquid 161 from the liquid reservoir 710 to the refuelling module liquid refuelling coupling 712. A liquid reservoir pump pressure controller 721 is connected to the refuelling module pump 720 and the refuelling module liquid delivery line 711 to ensure the flow rate of liquid 161 supplied through the refuelling module liquid delivery line 711 is controlled to maintain a relatively constant pressure within the refuelling module liquid delivery line 711. A refuelling module liquid delivery valve 713 is located within the refuelling module liquid delivery line 711.

A refuelling module liquid return line 730 is connected to the refuelling module liquid delivery line 711 and extends to the refuelling module liquid reservoir 710. A refuelling module liquid return valve 731 and a refuelling module back pressure valve 732 are located within the refuelling module liquid return line 730. Further, a refuelling module gas liquid separator 733 is located within the refuelling module liquid return line 730.

A refuelling module vapour recovery line 740 extends between the refuelling module reservoir 710 and a refuelling module gas refuelling coupling 741.

A refuelling module vapour recovery valve 742 is located within the refuelling module vapour recovery line 740. The refuelling module vapour recovery line 740 is connected to the main vapour recovery line 920.

A refuelling module high pressure gas line 750 is connected to the main high pressure gas line 910 and to the refuelling module gas refuelling coupling 741. A refuelling module high pressure gas valve 751 is located within the refuelling module high pressure gas line 750.

The engine module 1000 is mounted to a vehicle (not shown) and is used to supply gas to a vehicle combustion engine 1130 that drives vehicle. The engine module 1000 includes four engine module pressure vessels 1110, 1111, 1112, 1113 in the form of tanks. It should be appreciated that the number of engine pressure vessels may be varied in accordance with specific applications. The engine module pressure vessels 1110, 1111, 1112, 1113 are of similar format to the pressure vessels in FIG. 4 to FIG. 12.

An engine module gas line 1120 is used to connect the engine module pressure vessels 1110, 1111, 1112, 1113 to the engine module engine 1130. The engine module gas valves 1140, 1141, 1142, 1143 are located within the engine module gas line 1120 with each engine module pressure vessel 1110, 1111, 1112, 1113 having an associated engine module gas valve 1140, 1141, 1142, 1143. An engine module gas refuelling connection 1150 is attached to the engine module gas line in order to refill the engine module pressure vessels 1110, 1111, 1112, 1113.

An engine module liquid reservoir 1160 is connected to the engine module pressure vessels 1110, 1111, 1112, 1113 via an engine module liquid delivery line 1170 and an engine module liquid return line 1180. The liquid is typically water with salt being added to the water in low temperature environments. The engine module liquid inlet valves 1190, 1191, 1192, 1193 are used to permit delivery of liquid from the liquid reservoir 1160 to the engine module pressure vessels 1110, 1111, 1112, 1113 through the engine module liquid delivery line 1170. The engine module liquid outlet valves 1200, 1201, 1202, 1203 are used to allow liquid to return from the engine module pressure vessels 1110, 1111, 1112, 1113 through the engine module liquid return line 1180.

An engine module pump 1210 is located within the engine module liquid delivery line 1170 to pump liquid from the engine module liquid reservoir 1160 to the engine module pressure vessels 1110, 1111, 1112, 1113. It should be appreciated that the volume of liquid being supplied by the engine module pump 1210 may be varied according to the consumption requirement of the engine module engine 1130. An engine module pump pressure controller 1211 is connected to the engine module pump 1210 and the engine module liquid delivery line 1170 to ensure the flow rate of liquid supplied to the engine module pressure vessels 1110, 1111, 1112, 1113 is controlled to maintain a relatively constant pressure in the engine module pressure vessels 1110, 1111, 1112, 1113 from which gas is being transferred. The amount of liquid being delivered to the engine module pressure vessels 1110, 1111, 1112, 1113 can be controlled by using the engine module pump 1210 that is either a variable speed pump, a variable displacement pump, a constant speed pump with spill valves or a combination thereof.

The engine module liquid return line 1180 is also connected to an engine module liquid refuelling connection 1183. An engine module main liquid valve 1182 is located within the engine module liquid return line 1180 as is an engine module reservoir valve 1181. An engine module liquid gas separator 1240 is located within the engine module gas line 1120 to separate any liquid that may be supplied with gas from the engine module pressure vessels 1110, 1111, 1112, 1113. An engine module separator return line 1241 is connected from a base of the engine module liquid gas separator 1240 to the engine module liquid return line 1180. An engine module liquid return valve 1250 is located within the engine module separator return line 1241 and is operated by an engine module level switch 1251 to release liquid from the engine module liquid gas separator 1240 when the level of liquid within the engine module liquid gas separator 1240 has reached a predetermined level. Operation of the engine module level switch 1251 is used to determine when the pressure vessels 1110, 1111, 1112, 1113 supplying gas is full of liquid and trigger the next stage of operation.

It is envisaged that there are a number of other methods of triggering the next stage of operation including the use of an engine module pressure transmitter 1252 located within the engine module delivery line 1170 that measures the pressure spikes due to fluid velocity changes. A fluid operated obstruction device 1253 may be located adjacent the top of the engine module pressure vessels 1110, 1111, 1112, 1113 that enhances pressure spikes by allowing gas to pass through the fluid operated obstruction device easily but restricting the flow of liquid through the fluid operated obstruction device.

An engine module high pressure gas accumulator 1260 is located within the engine module gas line 1120 in order to assist in supplying gas to the engine 1130 at a relatively constant pressure and to provide a small reserve of gas whilst the system transfers the supply of gas from one engine module pressure vessels 1110, 1111, 1112, 1113 to subsequent engine module pressure vessels 1110, 1111, 1112, 1113. Further, an engine module gas accumulator valve 1131 is located between the high pressure gas accumulator 1260 and the engine module gas line 1120.

An engine module main gas valve 1121 is located within the vehicle gas line 1120 between the engine module pressure vessels 1110, 1111, 1112, 1113 and the engine module gas refuelling connection 1150.

In this example illustrate in FIGS. 31 to 38, the storage module pressure vessels 610, 611, 612, 613 start at 85% full and virtually all of the high pressure gas 270 from the engine module pressure vessels 1110, 1111, 1112, 1113 has been consumed by the engine module engine 1130. The storage module 600, vehicle refuelling module 700 and engine module 1000 are all inactive with a vehicle carrying the engine module 1000 coupled to the vehicle refuelling module 700.

In use and after coupling has occurred via couplings 741, 1150 and 712, 1183, the refuelling module vapour recovery valve 742 and the engine module main gas valve 1121 are switched to the open position. The refuelling module liquid delivery valve 713 and the engine module main liquid delivery valve 1182 are moved to the open position. Further, the storage module gas transfer valve 620 is also moved to the open position so that any gas supplied from the compression module 500 can be stored in the storage module pressure vessels 610, 611, 612, 613.

Figure 32:
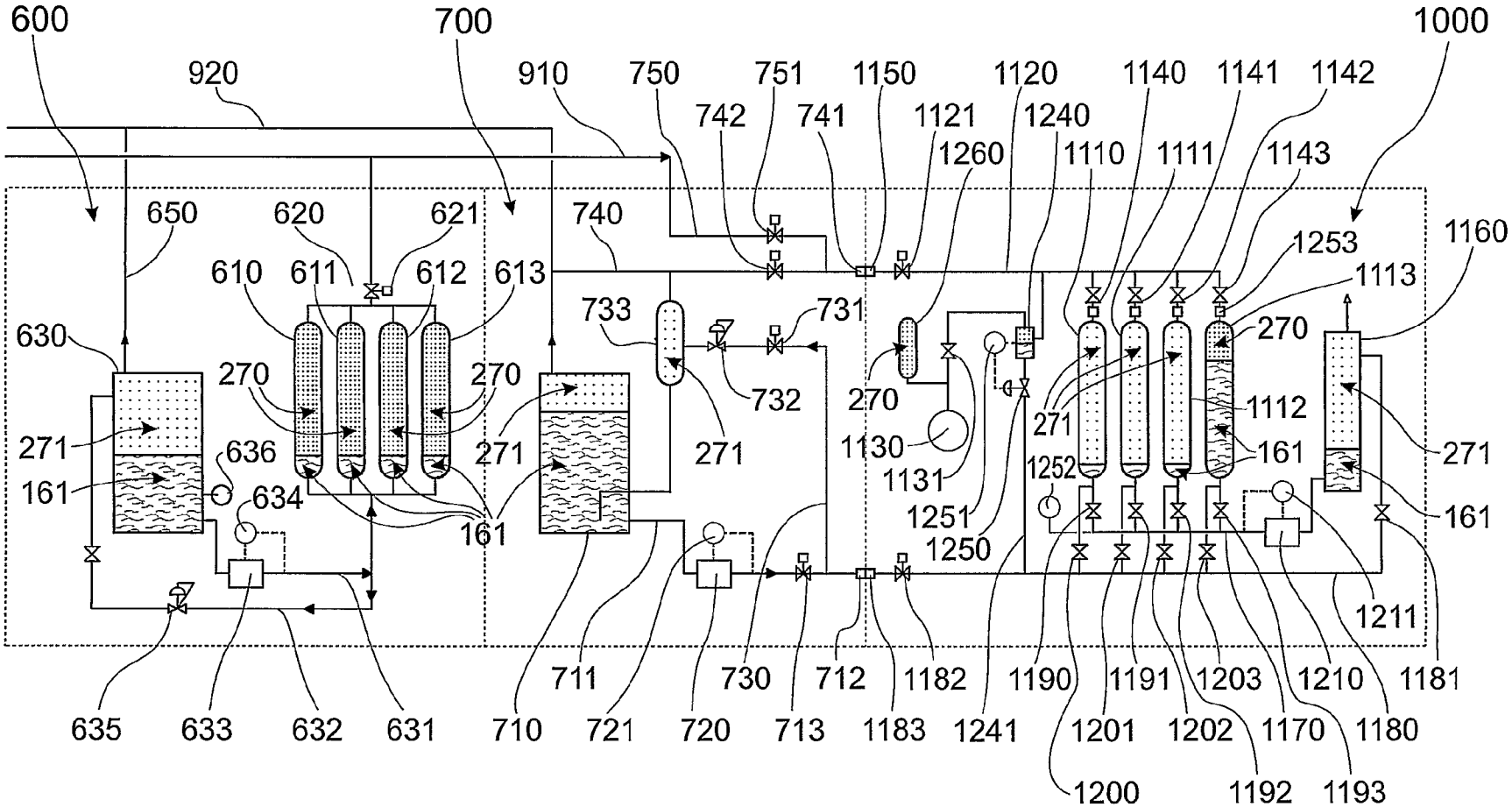
FIG. 32 is a schematic view of a compressed natural gas transfer system according to FIG. 19 in which low pressure gas is being removed from the vehicle module pressure vessels by liquid being pumped into the vehicle module pressure vessels.
Figure 33:
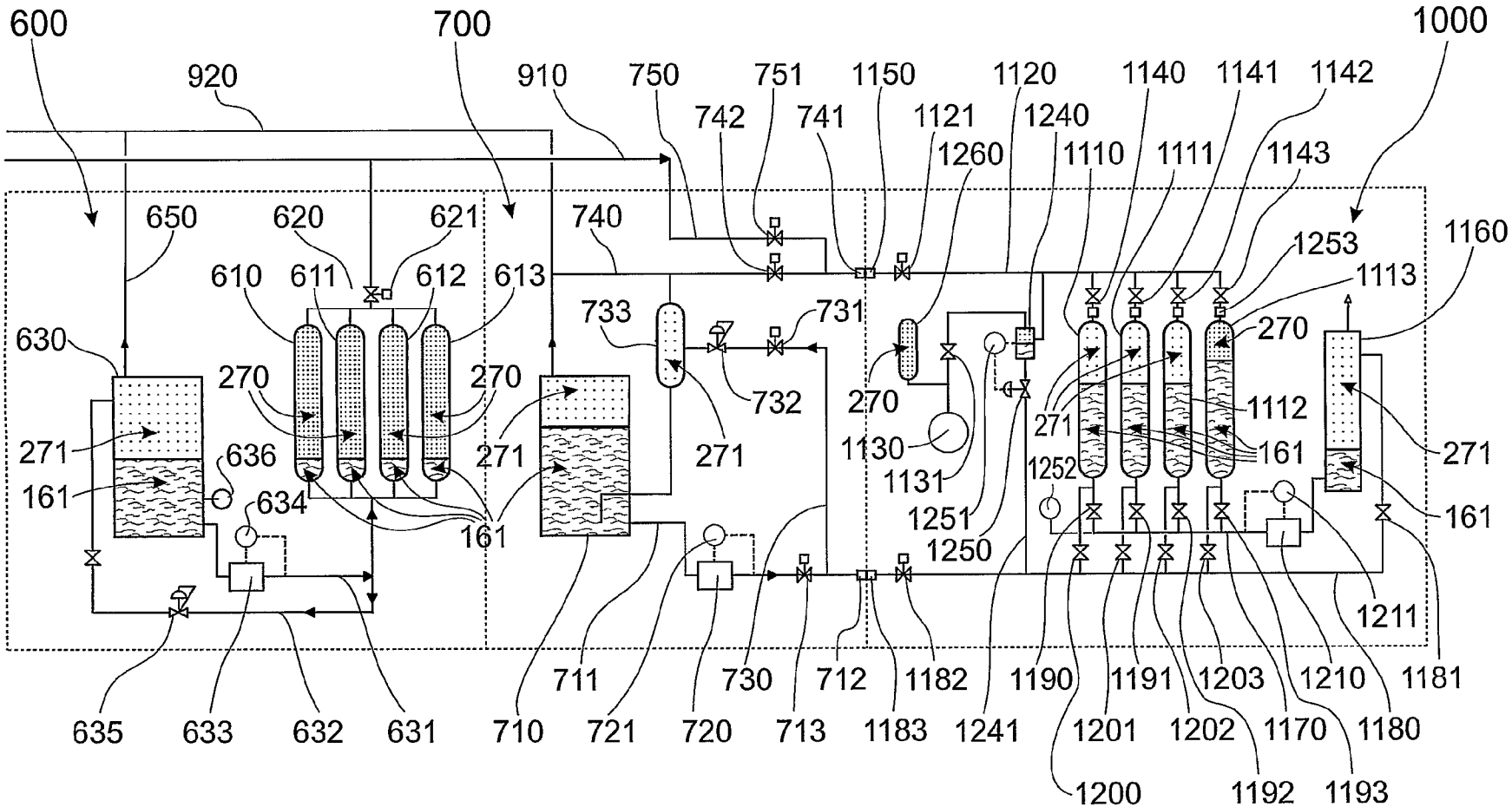
FIG. 33 is a schematic view of a compressed natural gas transfer system according to FIG. 19 in which low pressure gas is continued to be removed from the vehicle module pressure vessels by liquid being pumped into the vehicle module pressure vessels.
Figure 34:
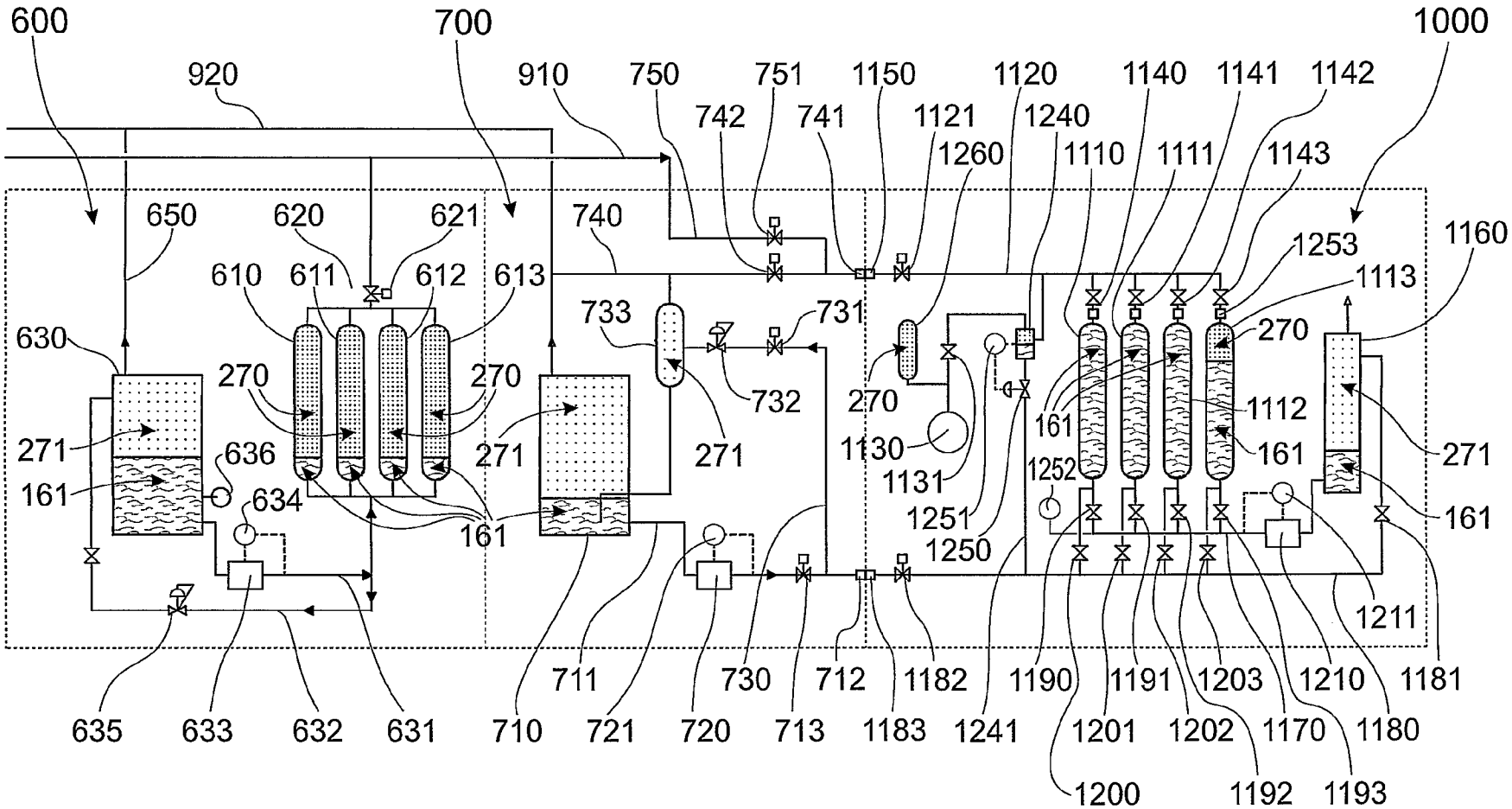
FIG. 34 is a schematic view of a compressed natural gas transfer system according to FIG. 19 in which liquid has filled the vehicle module pressure vessels.

Further, the first, the second and third engine module liquid outlet valves 1200, 1201, 1202 are moved to an open position as are the first, second and third engine module gas valves 1140, 1141, 1142. Liquid is then pumped from the vehicle refuelling module reservoir 710 through the engine module delivery line 711 through the engine module liquid return line and into the first, second and third engine module pressure vessels 1110, 1111, 1112 as shown in FIG. 32. This forces the low pressure residual gas to pass from the engine module pressure vessels 1110, 1111, 1112 through the engine module gas line 1120 into the refuelling module vapour recovery line 740 which leads to the gas vapour recovery line 920 as shown in FIG. 33. Once the first, second and third engine module pressure vessels 1110, 1111, 1112 are filled with liquid as shown in FIG. 34, the refuelling module vapour recovery valve 742 is switched to an off position. The refuelling module pump 720 is switched off and the refuelling module liquid delivery valve 713 is moved to a closed position. The refuelling module liquid return valve 731 is then switched to an open position. The fourth engine module gas valve 1143 is moved to an open position.

Figure 35:
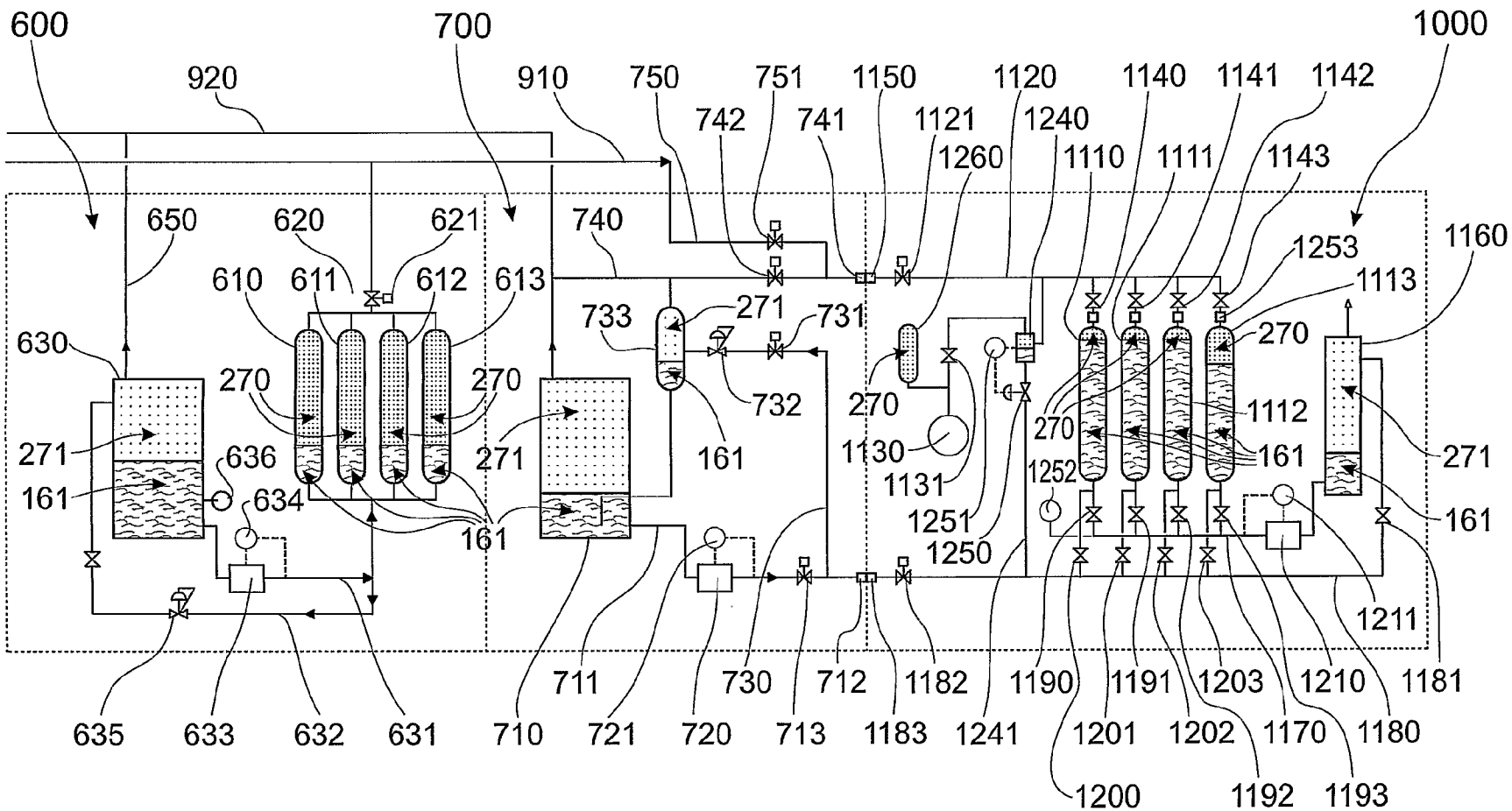
FIG. 35 is a schematic view of a compressed natural gas transfer system according to FIG. 19 in which gas is passed from the storage module pressure vessels to the vehicle module pressure vessels.
Figure 36:
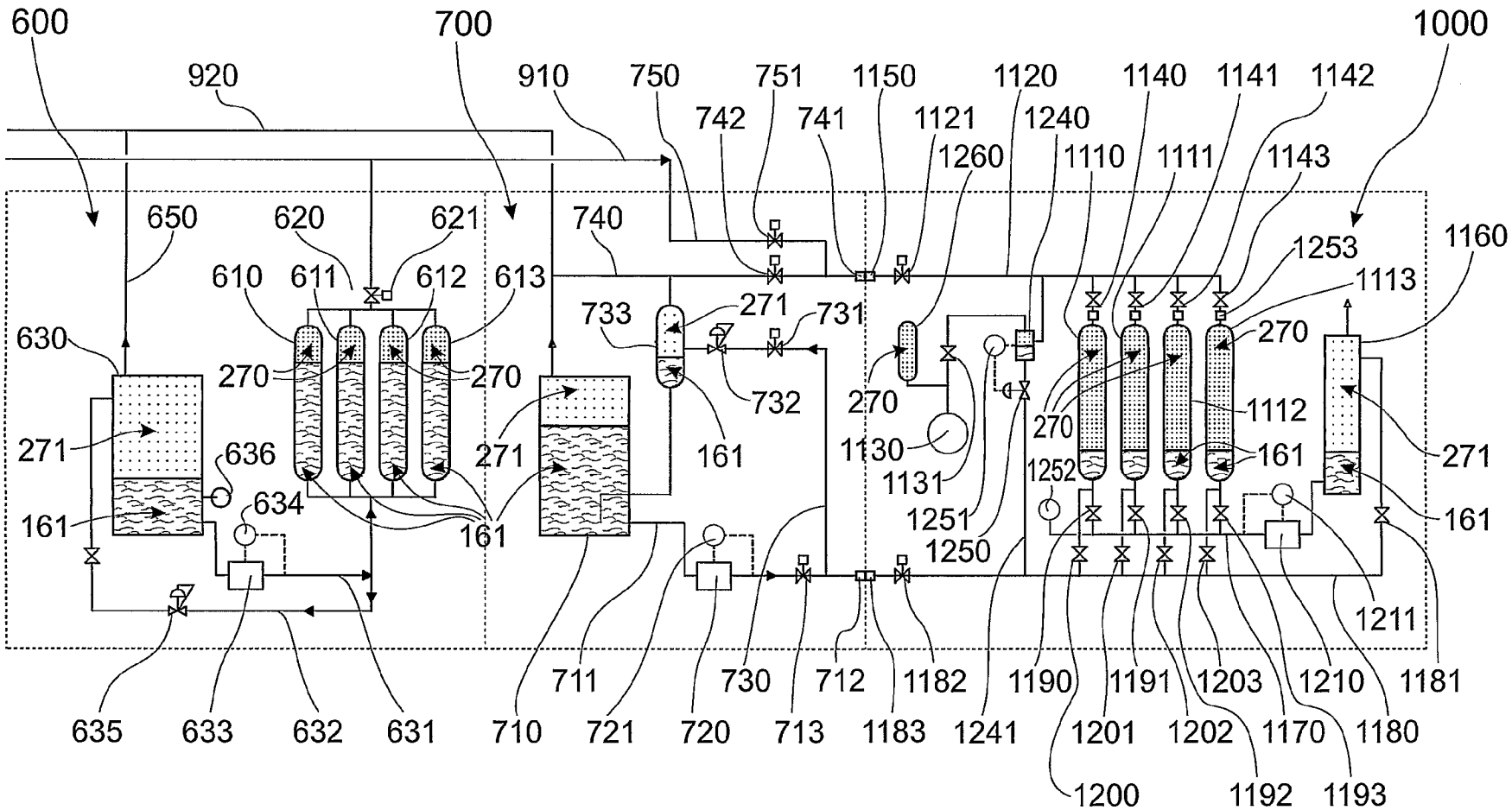
FIG. 36 is a schematic view of a compressed natural gas transfer system according to FIG. 19 in which gas is continued to be passed from the storage module pressure vessels to the vehicle module pressure vessels.

In FIG. 35, the storage module transfer valve 621 and the refuelling module high pressure gas valve 751 is moved to an open position. The storage module pump 633 is then activated to pump liquid 161 into the storage module pressure vessels 610, 611, 612, 613. This causes the high pressure gas to flow from the storage module pressure vessels 610, 611, 612, 613 through the refuelling module high pressure gas line 750 through the engine module gas line 1210 and into all of the engine module pressure vessels 1110, 1111, 1112, 1113 as shown in FIG. 36.

Figure 37:
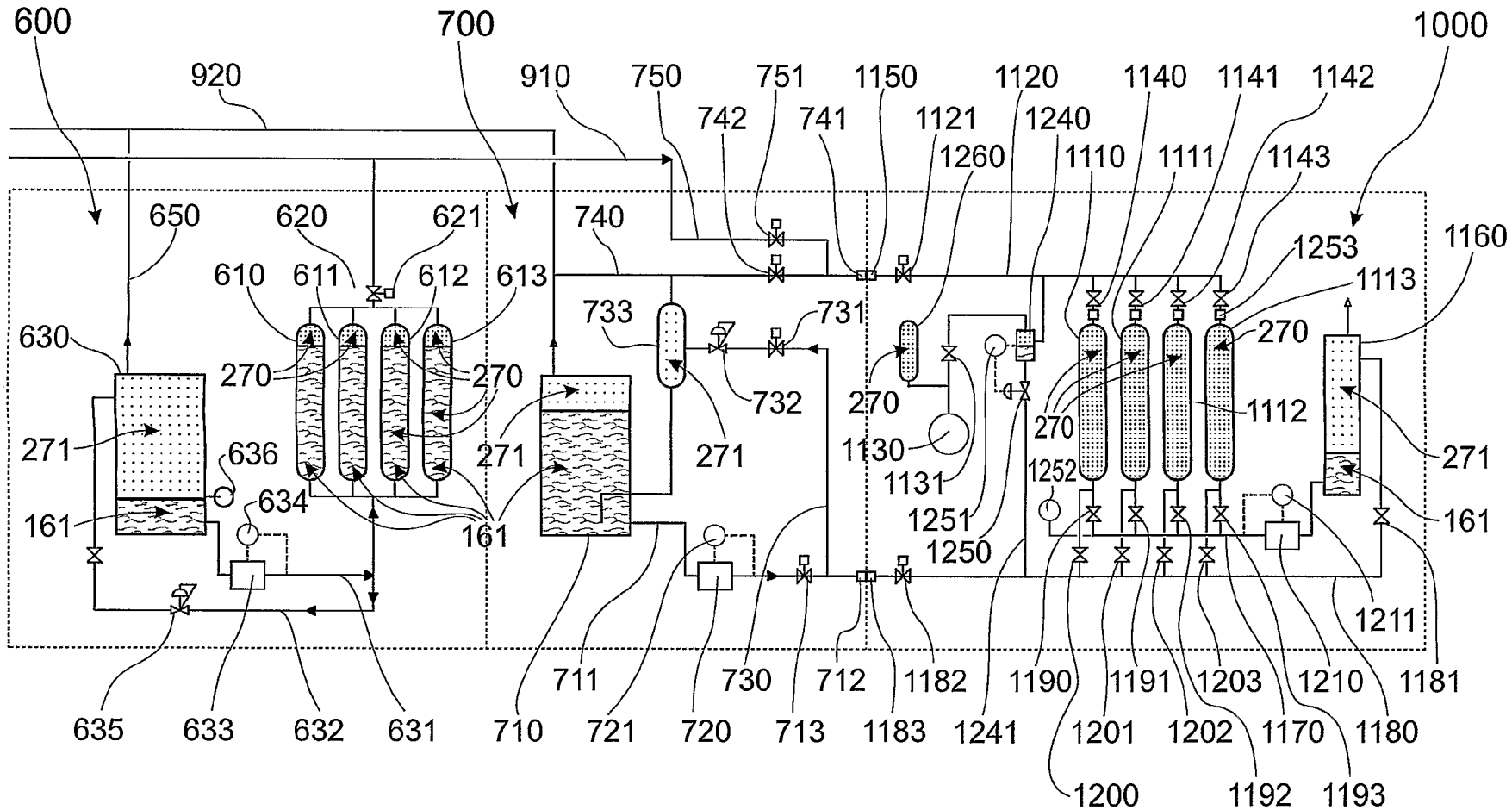
FIG. 37 is a schematic view of a compressed natural gas transfer system according to FIG. 19 in which high pressure gas has filled the vehicle module pressure vessels.

As high pressure gas flows into the engine module pressure vessels 1110, 1111, 1112, 1113, liquid 161 flows into the engine module liquid return line 1180, through the refuelling module liquid return line 731 through the refuelling module gas liquid separator 733 and into the refuelling module liquid reservoir 710 as shown further in FIG. 37.

Figure 38:
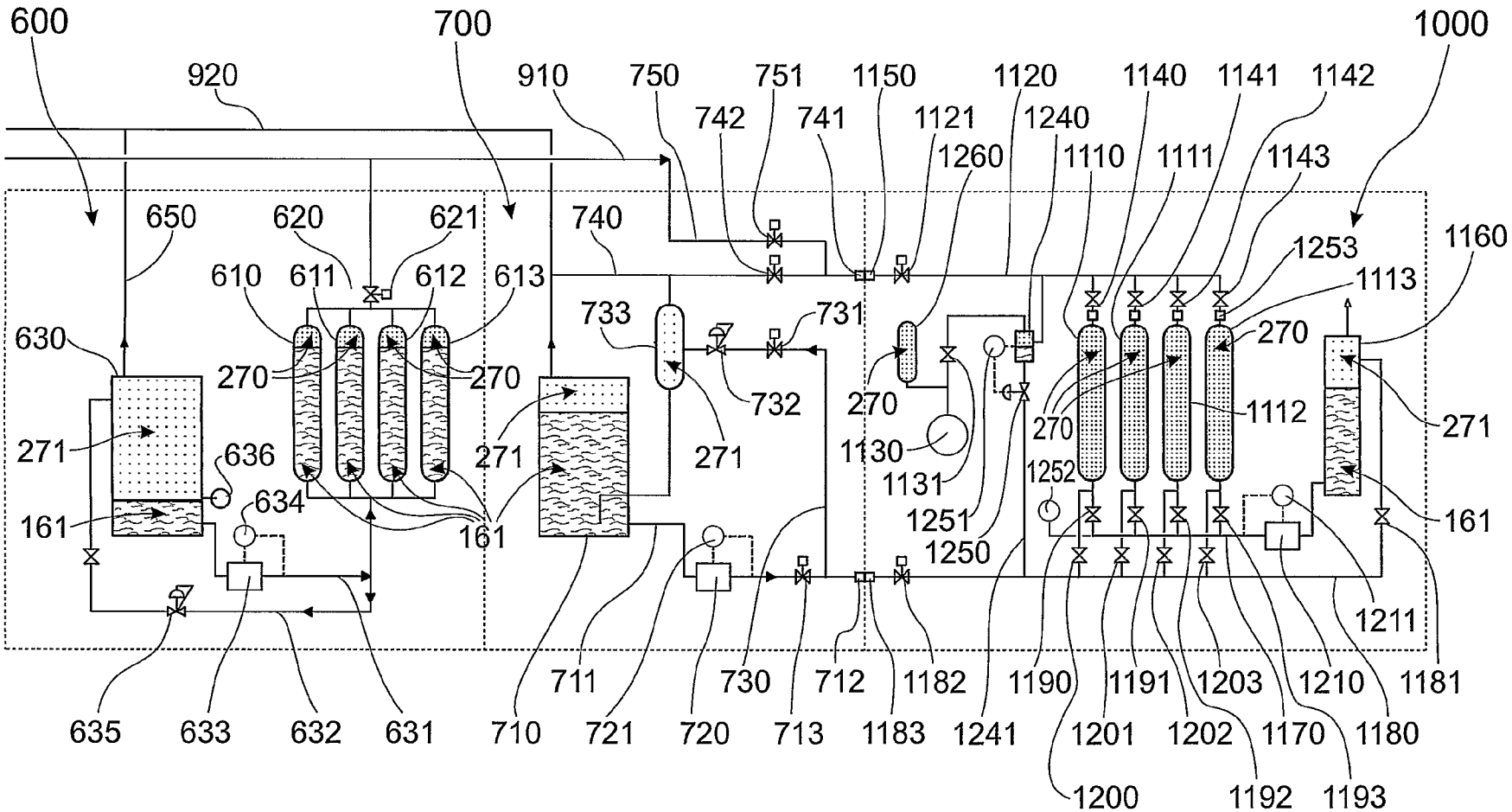
FIG. 38 is a schematic view of a compressed natural gas transfer system according to FIG. 19 wherein liquid is being pumped from the vehicle refuelling module reservoir to the vehicle module reservoir.

Once all the engine module pressure vessels 1110, 1111, 1112, 1113 are filled with high pressure gas as shown in FIG. 38, the refuelling module high pressure gas valve 751, engine module main gas valve 1121, engine module gas valves 1140, 1141 1142, 1143, engine module outlet valves 1200, 1201, 1202, 1203 and refuelling module return valve 731 are all moved to a closed position. Further, the storage module pump 633 is switched off and the storage module gas transfer valve 621 is closed. The refuelling module liquid delivery valve 713 and the engine module reservoir valve 1181 are then moved to an open position.

FIG. 38 shows the refuelling module pump 720 in operation pumping liquid 161 from the refuelling module reservoir 710 through the refuelling module liquid delivery line 711, through the engine module liquid return line 1180 and into the engine module reservoir 1160. Once the engine module reservoir 1160 is filled with liquid 161, the refuelling module pump 720 ceases operation and the refuelling module liquid delivery valve 713 and engine module main liquid valve 1182 are moved to a closed position. The engine module 1000 can then be decoupled by decoupling the engine module gas refuelling connection 1150 and the engine module refuelling connection 1183. The engine module engine 1130 can then be utilised until refuelling is again required.

The engine module operates to provide a relatively constant stream of high pressure gas to the engine in the same manner as described in FIGS. 5 to 12. Accordingly, this description has not been repeated.

It should be appreciated that there may be a number of vehicle refuelling modules similar to bowsers at a petrol station. The limitation to the number of vehicle refuelling modules is dependent upon the capacity of the storage module pressure vessels, i.e. the larger the storage module pressure vessels, the larger the number of vehicle refuelling modules that can be used.

It should also be appreciated that the storage pressure vessels may be filled remotely and transported to the storage module.

The invention provides a number of advantages. The invention allows a relatively constant supply of high pressure gas to be supplied to an engine simply. The invention is able to be used on vehicles due to multiple pressure vessels being used so that a smaller amount of liquid is required to supply the gas at a relatively constant pressure. When in filling mode, the invention eliminates the issue of partial fill caused by the extreme gas velocity friction heating in a conventional gas transfer which involves a high pressure gradient fast fill. The invention yields a constant one pass full fill by minimising the pressure gradient.

It should be appreciated that various other changes and modifications may be made to the embodiment described without departing from the spirit or scope of the invention.

The invention claimed is:

1. An on-vehicle compressed gas transfer system comprising:

at least one first pressure vessel able to hold a volume of gas on a vehicle;

a first gas line to allow gas to pass out of the at least one first pressure vessel;

a first liquid delivery line connected to the at least one first pressure vessel, including a first pump located within the first liquid delivery line, the first pump being able to pump liquid into the first pressure vessel via the first liquid delivery line to vary the volume of the at least one first pressure vessel; and a first liquid reservoir to hold a volume of liquid, the first liquid reservoir positioned on the vehicle and connected to the first liquid delivery line, wherein the first gas line is connected to a combustion engine of the vehicle to supply gas at a constant pressure to the combustion engine.

2. The compressed gas transfer system of claim 1 wherein there is a plurality of first pressure vessels.

3. The compressed gas transfer system of claim 2, wherein the volume of the liquid in the first reservoir is greater than the volume of a single first pressure vessel but less than the volume of the plurality of the first pressure vessels.

4. The compressed gas transfer system of claim 1, wherein the liquid is water.

5. The compressed gas transfer system of claim 4 wherein the water contains salt.

* * * * *